US006438522B1

(12) United States Patent
Minowa et al.

(10) Patent No.: US 6,438,522 B1
(45) Date of Patent: Aug. 20, 2002

(54) METHOD AND APPARATUS FOR SPEECH SYNTHESIS WHEREBY WAVEFORM SEGMENTS EXPRESSING RESPECTIVE SYLLABLES OF A SPEECH ITEM ARE MODIFIED IN ACCORDANCE WITH RHYTHM, PITCH AND SPEECH POWER PATTERNS EXPRESSED BY A PROSODIC TEMPLATE

(75) Inventors: Toshimitsu Minowa, Chigasaki; Hirofumi Nishimura; Ryo Mochizuki, both of Yokohama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/404,264

(22) Filed: Sep. 22, 1999

(30) Foreign Application Priority Data

Nov. 30, 1998 (JP) ..... 10-339019

(51) Int. Cl.[7] ..... G10L 13/00
(52) U.S. Cl. ..... 704/258; 704/268
(58) Field of Search ..... 704/200, 258, 704/268, 205, 207, 260, 265

(56) References Cited

U.S. PATENT DOCUMENTS

| | | | | |
|---|---|---|---|---|
| 4,716,591 A | | 12/1987 | Masuzawa et al. | |
| 5,715,368 A | | 2/1998 | Saito et al. | |
| 5,905,972 A | * | 5/1999 | Huang et al. | 704/268 |
| 6,163,769 A | * | 12/2000 | Acero et al. | 704/260 |
| 6,185,533 B1 | * | 2/2001 | Holm et al. | 704/267 |
| 6,260,016 B1 | * | 7/2001 | Holm et al. | 704/260 |

FOREIGN PATENT DOCUMENTS

| | | |
|---|---|---|
| EP | 0 821 344 A | 1/1998 |
| EP | 0 831 459 A | 3/1998 |
| GB | 0 833 304 A | 4/1998 |
| JP | 6-274195 | 9/1994 |
| JP | 7-261778 | 10/1995 |

OTHER PUBLICATIONS

Wu et al, "Template Driven Generation of Prosodic Information for Chinese Concatenative Synthesis", Proc. of the IEEE International Conf on Acoustics, Speech and SIgnal Processing, vol. 1, pp. 65–68.*

* cited by examiner

*Primary Examiner*—Richemond Dorvil
*Assistant Examiner*—Angela Armstrong
(74) *Attorney, Agent, or Firm*—Lowe Hauptman Gilman & Berner, LLP

(57) ABSTRACT

A method and apparatus for speech synthesis utilize a plurality of stored prosodic templates, each having been generated based on a series of enunciations of a single syllable executed in accordance with the rythm, pitch and speech power variations of an enunciated sample speech item, whereby the templates express rythm, speech power and pitch characteristics of respectively different sample speech items. Data representing an object speech item are converted to a sequence of acoustic waveform segments which respectively express the syllables of the speech item, the number of morae (syllable intervals) and the accent type of the speech item are judged and a prosodic template having the same number of morae and accent type is selected, and waveform shaping is applied to the waveform segments such as to match the rythm, speech power and pitch characteristics of the object speech item to those expressed by the selected prosodic template. The shaped acoustic waveform segments are then linked to form a continuous acoustic waveform, thereby obtaining synthesized speech which closely resembles natural speech.

30 Claims, 26 Drawing Sheets

FIG. 14

TABLE OF AUDITORY PERCEPTUAL TIMING POINTS OF SYLLABLES

| SYLLABLES | | | | | | | | | | POSITION OF AUDITORY PERCEPTUAL TIMING POINT |
|---|---|---|---|---|---|---|---|---|---|---|
| a | i | u | e | o | ka | ki | ku | ke | ko | STARTING POINT OF VOWEL |
| sa | | su | se | so | ta | | | te | to | |
| ha | | fu | he | ho | ga | gi | gu | ge | go | |
| za | | zu | ze | zo | pa | pi | pu | pe | po | |
| kya | | kyu | | kyo | | | | | | |
| | | tsu | | | tya | chi | tyu | tje | tyo | 20 ms AFTER START OF VOWEL |
| na | ni | nu | ne | no | ma | mi | mu | me | mo | IMMEDIATELY FOLLOWING THE "BUZZ" |
| ya | | yu | | yo | gya | | gyu | | yo | MID-POINT OF THE TRANSITION BETWEEN THE CONTRACTED SOUND AND THE HALF-VOWEL |
| sya | shi | syu | | syo | zya | zi | zyu | | zyo | |
| nya | | nyu | | nyo | hya | hi | hyu | | hyo | |
| bya | | byu | | byo | pya | | pyu | | pyo | |
| mya | | myu | | myo | rya | | ryu | | ryo | |
| ra | ri | ru | re | ro | da | | | de | do | THE CONSONANT BURST |
| | ba | bi | bu | be | bo | | | | | |
| wa | | | | | | | | | | POINT OF SUDDEN INCREASE OF POWER IN THE TRANSITION |
| N | | | | | | | | | | STARTING POINT OF THE SYLLABIC NASAL |

METHOD AND APPARATUS FOR SPEECH SYNTHESIS WHEREBY WAVEFORM SEGMENTS EXPRESSING RESPECTIVE SYLLABLES OF A SPEECH ITEM ARE MODIFIED IN ACCORDANCE WITH RHYTHM, PITCH AND SPEECH POWER PATTERNS EXPRESSED BY A PROSODIC TEMPLATE

BACKGROUND OF THE INVENTION

1. Field of Technology

The present invention relates to a speech synthesis method and apparatus, and in particular to a speech synthesis method and apparatus whereby words, phrases or short sentences can be generated as natural-sounding synthesized speech having accurate rythm and intonation characteristics, for such applications as vehicle navigation systems, personal computers, etc.

2. Prior Art

In generating synthesized speech from input data representing a speech item such as a word, phrase or sentence, the essential requirements for obtaining natural-sounding synthesized speech are that the rythm and intonation be as close as possible to those of that speech item when spoken by a person. The rythm of an enunciated speech item, and the average speed of enunciating its syllables, are defined by the respective durations of the sequence of morae of that speech item. Although the term "morae" is generally applied only to the Japanese language, the term will be used herein in with a more general meaning, as signifying "rythm intervals", i.e., durations for which respective syllables of speech item are enunciated.

The classification of respective sounds as "syllables" depends upon the particular language in which speech synthesis is being performed. For example, English does not have a syllable that is directly equivalent to the the Japanese syllable "N" (the syllabic nasal), which is considered to occupy one mora in spoken Japanese. Furthermore the term "accent" or "accented syllable" as used herein is to be understood as signifying, in the case of Japanese, a syllable which exhibits an abrupt drop in pitch. However in the case of English, the term "accented" is to be understood as applying to a syllable or word which is stressed. i.e. for which there is an abrupt increase in speech power. Thus although speech item examples used in the following description of embodiments of the invention are generally in Japanese, the invention is not limited in its application to that language.

One prior art system which is concerned with the problem of determining the rythm of synthesized speech is described in Japanese patent HEI 6-274195 (Japanese Language Speech Synthesis System forming Normalized Vowel Lengths and Consonant Lengths Between Vowel Center-of-Gravity Points). With that prior art system as shown in FIG. 21, a rule-based method is utilized, whereby the time interval between the vowel energy center-of-gravity points of the respective vowels of two mutually adjacent morae formed of a leading syllable 11 and a trailing syllable 12 is taken as being the morae interval between these syllables, and the value of that morae interval is determined by using the consonant which is located between the two morae and the pronunciation speed as parameters. The respective durations of each of the vowels of the two morae are then inferred, by using as parameters the vowel energy center-of-gravity interval and the consonant durations.

Another example of prior art systems for synthesized speech is described in Japanese patent HEI 7-261778

(Method and Apparatus for Speech Information Processing), whereby respective pitch patterns can be generated for words which are to be speech-synthesized. Such a pitch pattern defines, for each phoneme of a word, the phoneme duration and the form of variation of pitch in that phoneme. With the first embodiment of that invention, a pitch pattern is generated for a word by a process of:

(a) predeterming the respective durations of the phonemes of the word, (b) determining the number of morae and the position of any accented syllable (i.e., the accent type) of the word, (c) predetermining certain characteristic amounts, i.e., values such as reference values of pitch and speech power, for the word, (d) for each vowel of the word, looking up a pitch pattern table to obtain respective values for pitch at each of a plurality of successive time points within the vowel (these pitch values for a vowel being obtained from the pitch pattern table in accordance with the number of morae of the word, the mora position of that vowel and the position of any accented syllable in the word), and (e) within each vowel of the word, deriving interpolated values of pitch by using the set of pitch values obtained for that vowel from the pitch pattern table.

Interpolation from the vowel pitch values can also be applied to obtain the pitch values of any consonants in the word.

As shown in FIG. 22, that system includes a speech file 21 having stored therein a speech database of words which are expressed in a form whereby the morae number and accent type can be determined, with each word being assigned a file number. A word which is to be speech-synthesized is first supplied to a features extraction section 22, a label attachment section 23 and a phoneme list generating section 14. The label attachment section 23 determines the starting and ending time points for audibly generating each of the phonemes constituting the word. This operation is executed manually, or under the control of a program. The phoneme list generating section 14 determines the morae number and accent type of the word, and the information thus obtained by the label attachment section 23 and phoneme list generating section 14, labelled with the file number of the word, are combined to form entries for the respective phonemes of the word in a table that is held in a label file 16.

A characteristic amounts file 25 specifies such characteristic quantities as center values of fundamental frequency and speech power which are to be used for the selected word. The data which have been set into the characteristic amounts file 25 and label file 16 for the selected word are supplied to a statistical processing section 27, which contains the aforementioned pitch pattern table. The aforementioned respective sets of frequency values for each vowel of the word are thereby obtained from the pitch pattern table, in accordance with the environmental conditions (number of morae in word, mora position of that vowel, accent type of the word) affecting that vowel, and are supplied to a pitch pattern generating section 28. The pitch pattern generating section 28 executes the aforementioned interpolative processing to obtain the requisite pitch pattern for the word.

FIG. 23 graphically illustrates a pitch pattern which might be derived by the system of FIG. 22, for the case of a word "azi". The respective durations which have been determined for the three phonemes of this word are indicated as L1, L2, L3, and it is assumed that three pitch values are obtained by the statistical processing section 27 for each vowel, these being indicated as f1, f2, f3 for the leading vowel "a", with all other pitch values being derived by interpolation.

It will be apparent that it is necessary to derive the sets of values to be utilized in the pitch pattern table of the statistical processing section 27 by statistical analysis of large amounts of speech patterns, and the need to process such large amounts of data in order to obtain sufficient accuracy of results is a disadvantage of this method. Furthermore, although the resultant information will specify average forms of pitch variation, such an average form of pitch variation may not necessarily correspond to the actual intonation of a specific word in natural speech.

With the prior art method of FIG. 21 on the other hand, the rythm of the resultant synthesized speech, i.e., the rythm within a word or sentence, is determined only on the basis of assumed timing relationships between each of respective pairs of adjacent morae, irrespective of the actual rythm which the word or sentence would have in natural speech. Hence it will be impossible to generate synthesized speech having a rythm which is close to that of natural speech.

There is therefore a requirement for a speech synthesis system whereby the resultant synthesized speech is substantially close to natural speech in its rythm and intonation characteristics, but which does not require the acquisition, processing and storage of large amounts of data to achieve such results and therefore would be suited to small-scale types of application such as vehicle navigation systems, personal computers, etc.

SUMMARY OF THE INVENTION

It is an objective of the present invention to overcome the disadvantages of the prior art described above by providing a method and apparatus for speech synthesis whereby synthesized speech can be reliably generated in which the rythm, speech power variations and pitch variations are close to those of natural speech, without requirements for executing complex processing operations on large amounts of data or for storing large amounts of data.

The basis of the present invention lies in the use of prosodic templates, each consisting of three sets of data which respective express specific rythm, pitch variation, and speech power variation characteristics. Each prosodic template is generated by a human operator, who first enunciates into a microphone a sample speech item (or listens to the item being enunciated), then enunciates a series of repetitions of a single syllable, referred to herein as the reference syllable, with these enunciations being as close a possible in rythm, pitch variations and speech power variations to those of the sample speech item. The resultant acoustic waveform is analyzed to extract data expressing, the rythm, the pitch variation, and the speech power variation characteristics of that sequence of enunciations, to constitute in combination a prosodic template. In addition, the number of morae and accent type of the sequence of enunciations of the reference syllable are determined.

To achieve the above objective, the basic features of the present invention are as follows:

(1) Generating and storing in memory beforehand a plurality of such prosodic templates, derived for respectively different sample speech items, and classified in accordance with number of morae and accent type, (2) Thereafter, converting a set of primary data which express an object speech item in the form of text or a rythm alias into an acoustic waveform expressing speech, by successive steps of:

(a) judging the number of morae and the accent type of the speech item, (b) selecting one of the stored prosodic templates which has an identical number of morae and accent type to the speech item, (c) generating a sequence of acoustic waveform segments which express the sequence of syllables constituting the object speech item, (d) shaping these acoustic waveform segments such as to bring the rythm of the object speech item close to that of the selected prosodic template, (e) shaping the resultant acoustic waveform segments such as to bring the pitch variation and speech power variation characteristics of the object speech item close to those of the selected prosodic template, and (f) linking the resultant shaped acoustic waveform segments into a continuous waveform.

Preferably, the invention should be applied to speech items having no more than nine morae.

The invention provides various ways in which the rythm of an object speech item can be matched to that of a selected prosodic template. For example the rythm data of a stored prosodic template may express only the respective durations of the vowel portions of each of the reference syllable repetitions. In that case, each portion of the acoustic waveform segments which expresses a vowel of the object speech item is subjected to waveform shaping to make the duration of that vowel substantially identical to that of the corresponding vowel expressed in the selected prosodic template.

Alternatively, the rythm data set of each stored prosodic template may express only the respective intervals between adjacent pairs of reference time points which are successively defined within the sequence of enunciations of the reference syllable. Each of these reference time points can for example be the vowel energy center-of-gravity point of a syllable, or the starting point of a syllable, or the auditory perceptual timing point (described hereinafter) of that syllable. In that case, the acoustic waveform segments which express the object speech item are subjected to waveform shaping such as to make the duration of each interval between a pair of adjacent ones of these reference time points substantially identical to the duration of the corresponding interval which is specified in the selected prosodic template.

The data expressing a speech power variation characteristic, in each stored prosodic template, can consist of data which specifies the respective peak values of each sequence of pitch waveform cycles constituting a vowel portion of a syllable. In that case, the speech power characteristic of the object speech item is brought close to that of the selected prosodic template by executing waveform shaping of each of the pitch waveform cycles constituting each vowel portion expressed by the acoustic waveform segments, such as to make each peak value of a pitch waveform cycle match the peak value of the corresponding pitch waveform cycle in the corresponding vowel as expressed by the speech power data of the selected prosodic template.

Alternatively, the data expressing the speech power variation characteristic expressed in a prosodic template can consist of data which specifies the respective average peak values of each set of pitch waveform cycles constituting a vowel portion of an enunciation of the reference syllable. In that case, the speech power characteristic of the object speech item is brought close to that of the selected prosodic template by executing waveform shaping of the pitch waveform cycles constituting each vowel expressed by the acoustic waveform segments, such as to make each peak value substantially identical to the average peak value of the corresponding vowel portion that is expressed by the speech power data of the prosodic template.

In addition the data expressing a pitch variation characteristic, of each stored prosodic template, can consist of data which specifies the respective pitch periods of each set of pitch waveform cycles constituting a vowel portion of an enunciation of the reference syllable. In that case, the pitch characteristic of the object speech item is brought close to that of the selected prosodic template by executing waveform shaping of each of the pitch waveform cycles constituting each vowel portion expressed by the acoustic waveform segments, such as to make each pitch period substantially identical to the that of the corresponding pitch waveform cycle in the corresponding vowel portion which is expressed by the pitch data of the selected prosodic template.

Furthermore, in addition to adjustment of the pitch of vowels of the object speech item, it is also possible to adjust the pitch of each voiced consonant of the object speech item to match that of the corresponding portion of the selected prosodic template.

As a further alternative, each vowel portion of a syllable expressed by a prosodic template is divided into a plurality of sections, such as three or four sections, and respective average values of pitch period and average values of peak value are derived for each of these sections. The pitch period average values are stored as the pitch data of a prosodic template, while the peak value average values are stored as the speech power data of the template. In that case, the pitch characteristic of an object speech item is brought close to that of the selected prosodic template by dividing each vowel into the aforementioned plurality of sections and executing waveform shaping of each of the pitch waveform cycles constituting each section, as expressed by the aforementioned acoustic waveform segments, to make the pitch period in each of these vowel sections substantially identical to the average pitch period of the corresponding section of the corresponding vowel portion as expressed by pitch data of the selected prosodic template.

Similarly, the speech power characteristic of the object speech item is brought close to that of the selected prosodic template by executing waveform shaping of each of the pitch waveform cycles constituting each section of each vowel expressed by the acoustic waveform segments such as to make the peak value throughout each of these vowel sections substantially identical to the average peak value of the corresponding section of the corresponding vowel portion as expressed by the speech power data of the selected prosodic template.

BRIEF DESCRIPTION OF THE DRAWINGS

FIG. 14 is a table showing respective positions of auditory perceptual timing points within syllables of the Japanese language;

DESCRIPTION OF PREFERRED EMBODIMENTS

Before describing embodiments of the present invention, the process of generating prosodic templates for use with the invention will first be explained.

A prosodic template is generated by extracting the rythm, pitch variation and speech power variation components of a sample speech item which may be a word, phrase or sentence and is formed of no more than nine morae, as follows. First, a human operator, immediately after enunciating the sample speech item (or listening to it being enunciated), utters into a microphone a sequence of repetitions of one predetermined syllable such as "ja" or "mi", which will be referred to in the following as the reference syllable, with that sequence being spoken closely in accordance with the rythm, pitch variations, and speech power variations in the enunciated speech item. If the reference syllable is "ja" and the spoken speech item has for example six morae with the fourth mora being accented, such as the Japanese place name whose pronunciation is "midorigaoka" (where the syllables "mi, do, ri, ga, o, ka" respectively correspond to the six morae) with the "ga" being accented, then the sequence of enunciations of the reference syllable would be "jajajaja'jaja", where "ja'" represents the accented syllable.

Such a series of enunciations of the reference syllable is then converted to corresponding digital data, by being sampled at a sufficiently high frequency.

Figure 1A:
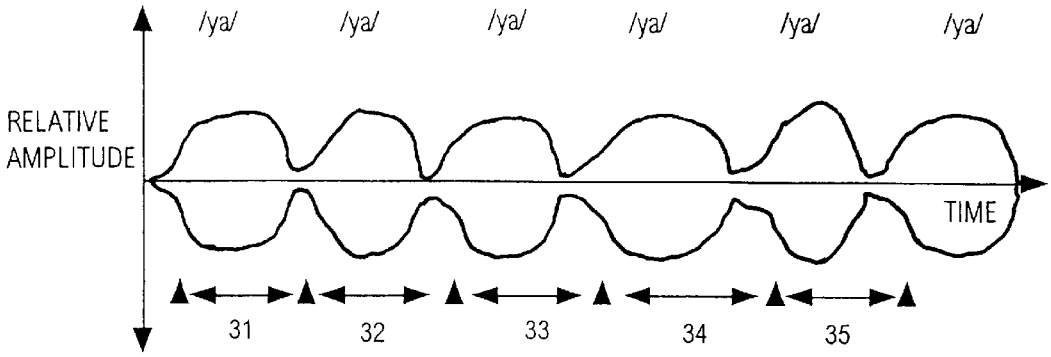
FIGS. 1A to 1C are diagrams for graphically illustrating sets of data respectively constituting a rythm template, a pitch template and a power template, for use in generating a prosodic template.

FIG. 1A graphically illustrates an example of the contents of such a data set, i.e., the acoustic waveform amplitude variation characteristic along the time axis, obtained for such a series of enunciations of the reference syllable, which will be referred to as a rythm template. The intervals between the approximate starting points of the respective vowel portions of the syllables (each mora corresponding to one syllable as described above) are designated by numerals 31 to 35 respectively.

To extract the pitch variation characteristic of the sample speech item, the acoustic waveform amplitude/time pattern of the speech item (the rythm template data illustrated in FIG. 1A) is analyzed to obtain data expressing the successive values of pitch period constituting that series of enunciations of the reference syllable. Such a set of data, graphically illustrated by FIG. 1B in the form of a frequency characteristic, will be referred to as a pitch template. The rythm template data are also analyzed to obtain the successive peak values of the waveform (i.e., peak values of respective pitch waveform cycles, as described hereinafter) which determine the level of speech power, with the resultant data being referred to as the power template that is is graphically illustrated by FIG. 1C.

Figure 1B:
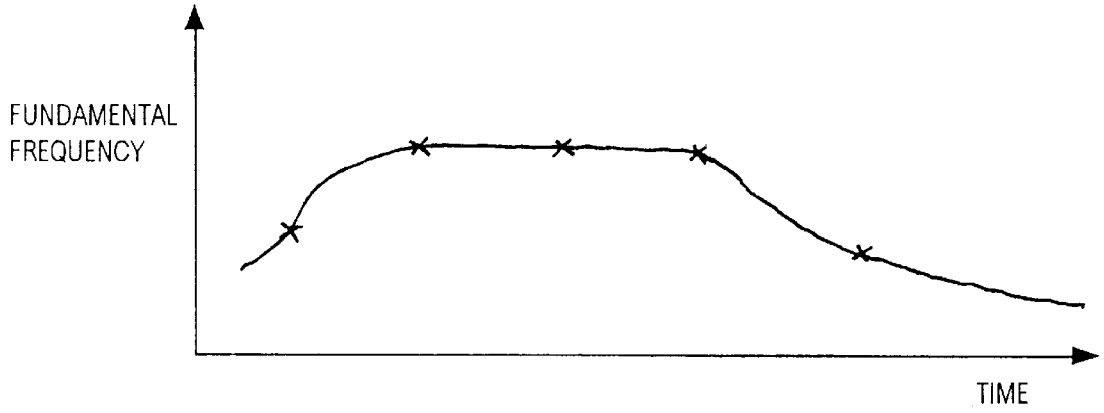

In FIG. 1B, the respective cross symbols indicate the respective values of pitch at mid-points of the syllables corresponding to the six morae.

Figure 3:
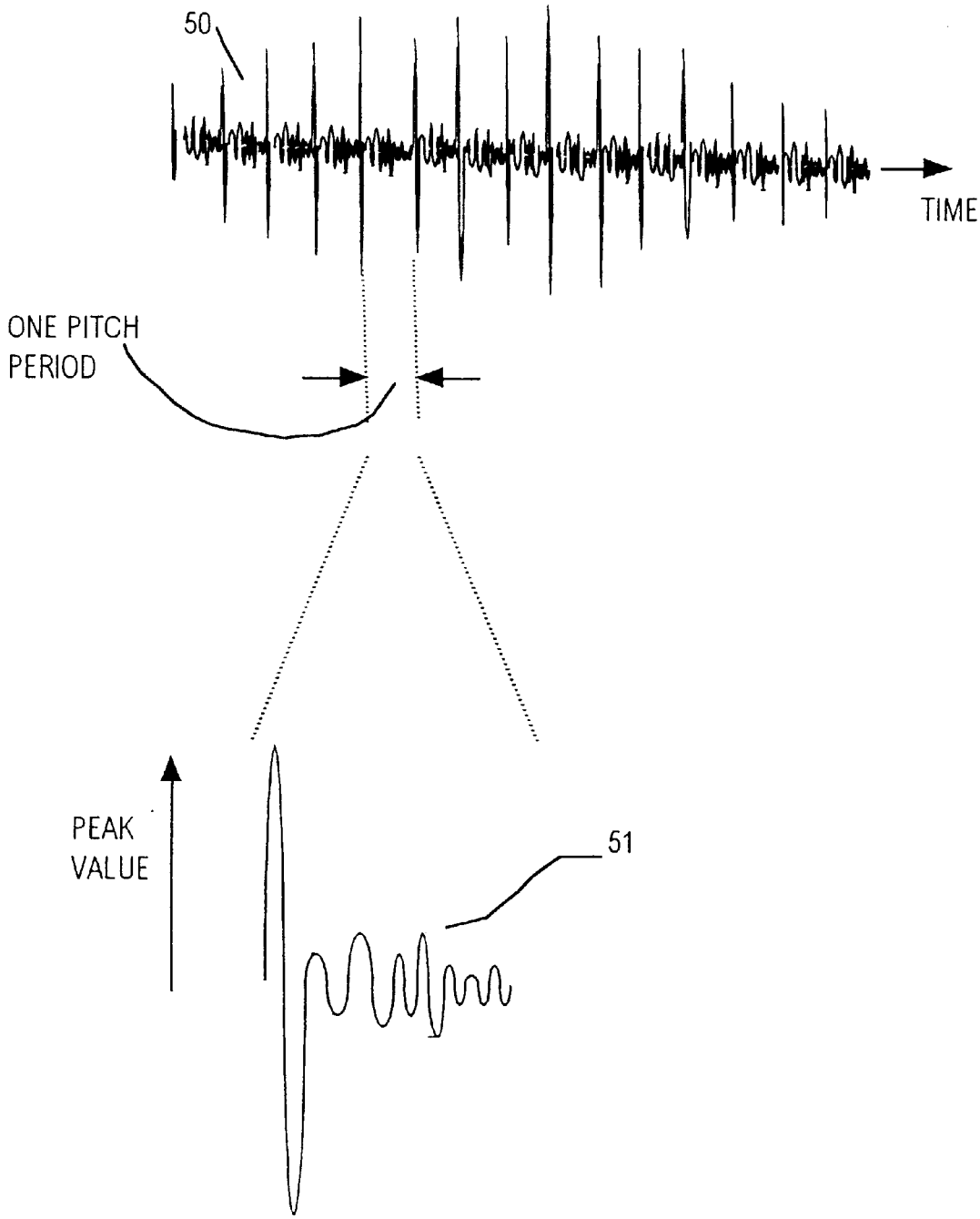
FIG. 3 illustrates the relationship between pitch waveform cycles, peak value and pitch periods, of the waveform of a phoneme.

FIG. 3 illustrates the speech waveform variation of a phoneme. As indicated by numeral 50, this contains a succession of large-amplitude waveform peaks, whose values are referred to herein simply as the peak values, whose average constitutes the average speech power of the phoneme, and whose repetition frequency (i.e., the "pitch" of the phoneme) is generally referred to as the fundamental frequency, with the interval between an adjacent pair of these peaks constituting one pitch period. The actual waveform within a specific pitch period will be referred to as a pitch waveform cycle. An example of a pitch waveform cycle and its peak value are indicated by numeral 51 in FIG. 3.

A combination of three data sets respectively expressing the rythm, pitch variation and speech power variation characteristics of a sample speech item, extracted from the three sets of template data illustrated in FIGS. 1A, 1B and 1C respectively, as required for the operation of a particular embodiment of the invention, will be referred to in the following as a prosodic template.

The acoustic waveform peak values and average peak values of a speech item or expressed in the speech power data of a prosodic template are of course relative values.

Figure 1C:
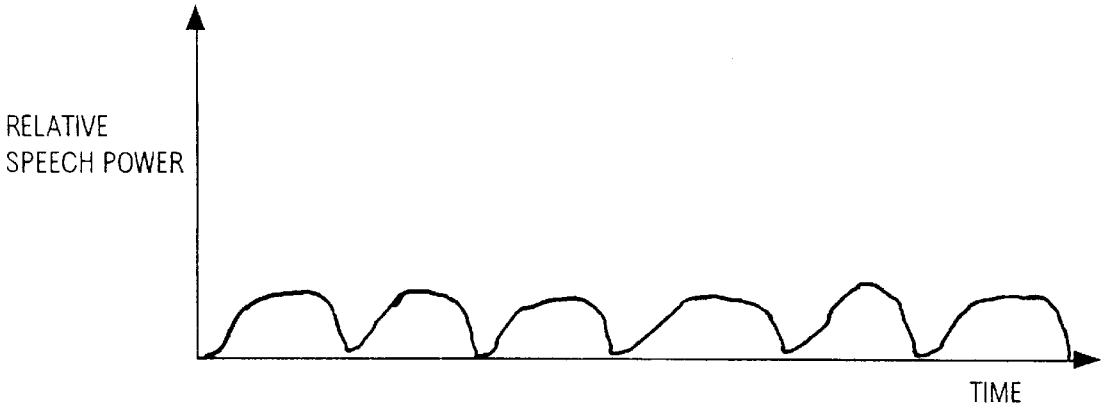

The rythm, pitch and power templates illustrated in FIGS. 1A to 1C are respective complete sets of data each obtained for the entirety of a sample speech item. However as indicated above, only specific parts of these data sets are selected to constitute a prosodic template. For example if the intervals 31 to 35 in FIG. 1A are the respective intervals between the starting points of each of the vowel portions of the syllables of the six morae, then only these interval values will be stored as the rythm data of a prosodic template, in the case of one of the embodiments of the invention described hereinafter.

A number of such prosodic templates are generated beforehand, using various different sample speech items, and are stored in a memory, with each template classified according to number of morae and accent type.

A first embodiment of a method according to the invention will be described referring to the flow diagram of FIG. 2A. In a first step S1, primary data expressing a speech item that is to be speech-synthesized are input. As used herein, the term "primary data" signifies a set of data representing a speech item either as:

(a) text characters, or (b) data which directly indicate the rythm and pronunciation of the speech item, i.e., a rythm alias.

In the case of a Japanese speech item for example, the primary data may represent a sequence of text characters, which could be a combination of kanji characters (ideographs) or a mixture of kanji characters and kana (phonetic characters). In that case it may be possible for the primary data to be analyzed to directly obtain the number of morae and the accent type of the speech item. However more typically the primary data would be in the form of a rythm alias, which can directly provide the number of morae and accent type of the speech item. As an example, for a certain place name "midorigaoka" which is generally written as a sequence of three kanji , the corresponding rythm alias would be [mi do ri ga o ka, 64], where "mi", "do", "ri", "ga", "o", "ka" represent six kana expressing respective Japanese syllables, corresponding to respective morae, and with "64" indicating the rythm type, i.e., indicating that that the fourth syllable of the six morae is accented.

In a second step S2, the primary data set is converted to a corresponding sequence of phonetic labels, i.e., a sequence of units respectively corresponding to the syllables of the speech item and each consisting of a single vowel (V), a consonant-vowel pair (CV), or a vowel-consonant-vowel (VCV) combination. With the present invention, such a phonetic label set preferably consists of successively overlapping units, with the first and final units being of V or CV type and with all other units being of VCV type. In that case, taking the above example of the place name "midorigaoka", the corresponding phonetic label set would consist of seven units, as:

/mi/+/ido/+/ori/+/iga/+/ao/+/oka/+/a/

In addition, the phonetic label set or the primary data is judged, to determine the number of morae and the accent type of the speech item to be processed.

Next, in step S3, a set of sequentially arranged acoustic waveform segments corresponding to that sequence of phonetic labels is selected, from a number of acoustic waveform segments which have been stored beforehand in a memory. Each acoustic waveform segment directly represents the acoustic waveform of the corresponding phonetic label.

In step S4, a prosodic template which has an identical number of morae and identical accent type to that of the selected phonetic label set is selected from the stored plurality of prosodic templates.

In step S5, each vowel that is expressed within the sequence of acoustic waveform segments is adjusted to be made substantially identical in duration to the corresponding vowel expressed by the selected prosodic template. With this embodiment the rythm data of each prosodic template consists of only the respective durations of the vowel portions of the respective syllables of that template.

Figure 5:
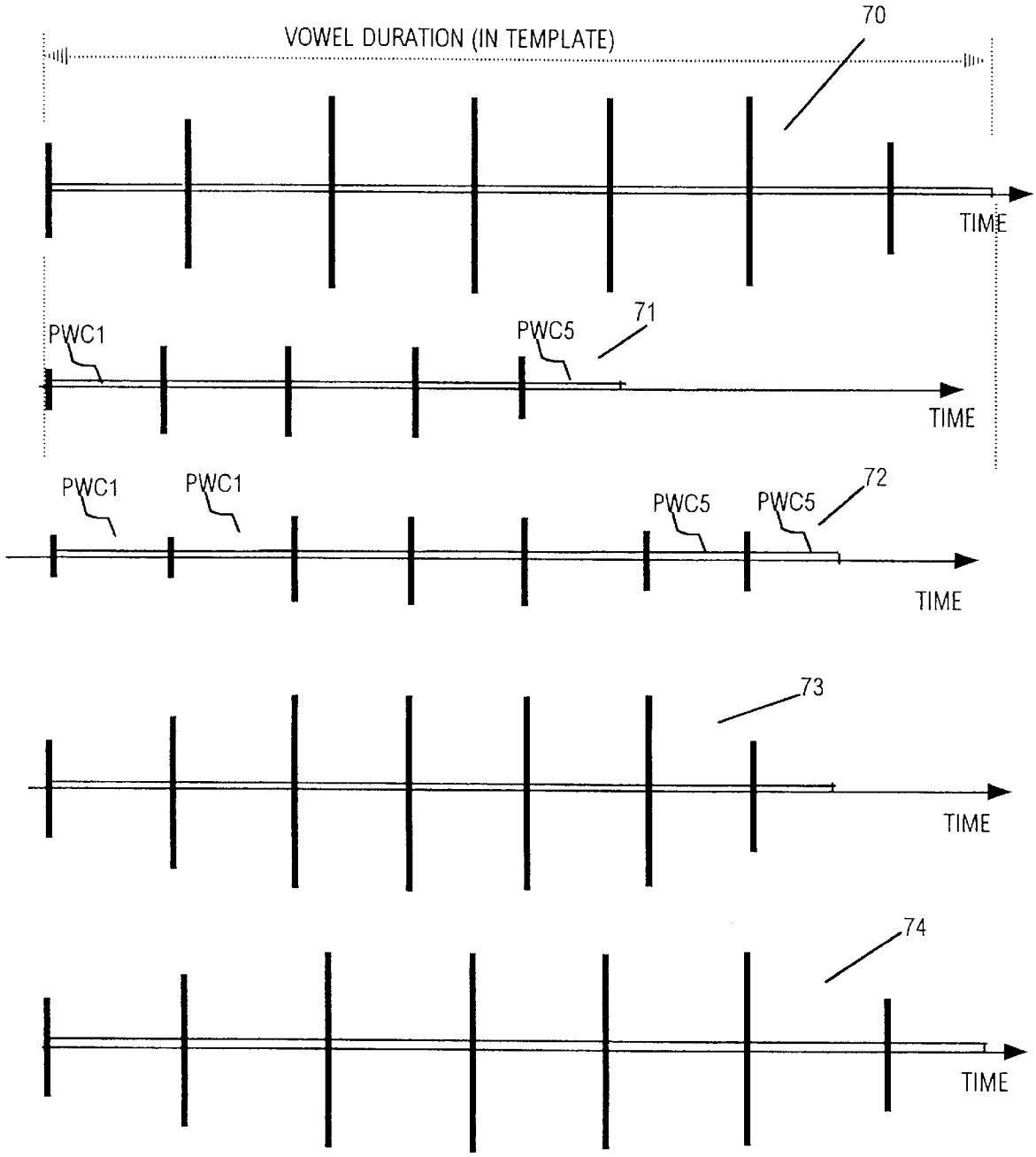
FIG. 5 is a timing diagram illustrating a process of increasing the duration of a vowel portion of an acoustic waveform segment to match a corresponding vowel portion expressed by a prosodic template.

The adjustment of vowel duration is executed by waveform shaping of the corresponding acoustic waveform segment, as illustrated in very simplified form in FIG. 5, in which the positions of peak values of the pitch waveform cycles are indicated by respective vertical lines. It is assumed in this example that a specific vowel 70 of the syllable sequence of the selected prosodic template consists of seven pitch waveform cycles, with the duration of the vowel being as indicated. It is further assumed that the corresponding vowel expressed in the selected set of acoustic waveform segments has a shorter duration, being formed of only four pitch waveform cycles, as indicated by numeral 71. (For ease of understanding, initial differences between the pitch periods of the vowel expressed in the template and those of the vowel expressed in the acoustic waveform segment have been exaggerated in the diagram). As indicated by numeral 72, the vowel expressed by the acoustic waveform segment is adjusted such as to change the number of pitch waveform cycles to approximately match the duration of the corresponding vowel expressed in the selected prosodic template, i.e., by increasing the number of pitch waveform cycles from five to seven. As illustrated, this increase is performed by repetitively executing operations of copying the leading pitch waveform cycle (PWC1) into a time-axis position immediately preceding that pitch waveform cycle, copying the final pitch waveform cycle (PWC5) into a position immediately following that pitch waveform cycle, again copying the leading pitch waveform cycle into a preceding position, and so on in succession until the requisite amount of change in the number of pitch waveform cycles has been achieved.

Figure 2A:
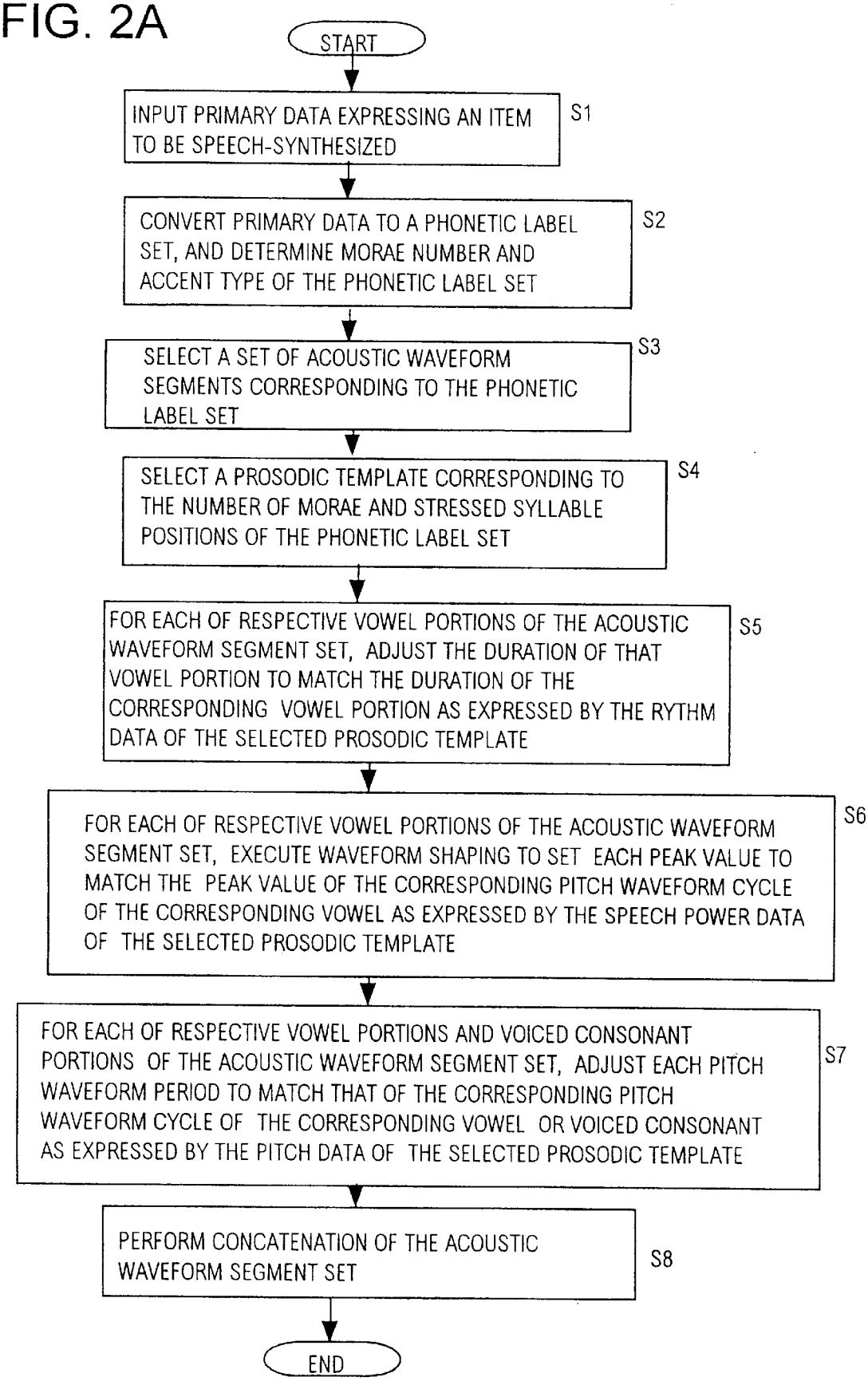
FIG. 2A is a flow diagram of processing executed with a first embodiment of a method of speech synthesization.

Next, in step S6 of FIG. 2A, waveform shaping is performed to match the speech power variation characteristic of each of the vowels expressed by the acoustic waveform segments to that of the corresponding vowel expressed in the selected prosodic template. As shown by numeral 73 in FIG. 5, the respective peak value of a vowel expressed in the acoustic waveform segments are adjusted in amplitude such as to match the corresponding peak value of the corresponding vowel expressed in the prosodic template (where "corresponding", as used herein with respect to relationships between phonemes or pitch waveform cycles of a speech item being processed and those expressed by a phonetic template, signifies "correspondingly positioned within the sequence of phonemes, or within the sequence of pitch waveform cycles peaks of a specific phoneme"), so that the speech power variation characteristic of the modified vowel will become matched to that which is specified by the speech power data of the prosodic template, for the corresponding vowel.

Adjustment of the pitch variation characteristic of each vowel expressed in the acoustic waveform segment sequence to match the corresponding vowel expressed in the selected prosodic template is then executed, in step S7 of FIG. 2A. In addition, the pitch of each voiced consonant expressed in the acoustic waveform segments is similarly adjusted to match the pitch of the corresponding portion of the prosodic template.

As indicated by numeral 74 in FIG. 5, matching of vowel pitch is performed with this embodiment by adjusting the periods of respective pitch waveform cycles in each vowel expressed in the acoustic waveform segment sequence (in this case, by increasing the periods) such as to become identical to those of the corresponding pitch waveform cycles in the corresponding vowel as expressed by the pitch data of the selected prosodic template.

As a result, the portion of the acoustic waveform segment set which has been adjusted as described above now expresses a vowel sound which is substantially identical in duration, speech power variation characteristic, and pitch variation characteristic to that of the correspondingly positioned vowel sound in the selected prosodic template.

Figure 4:
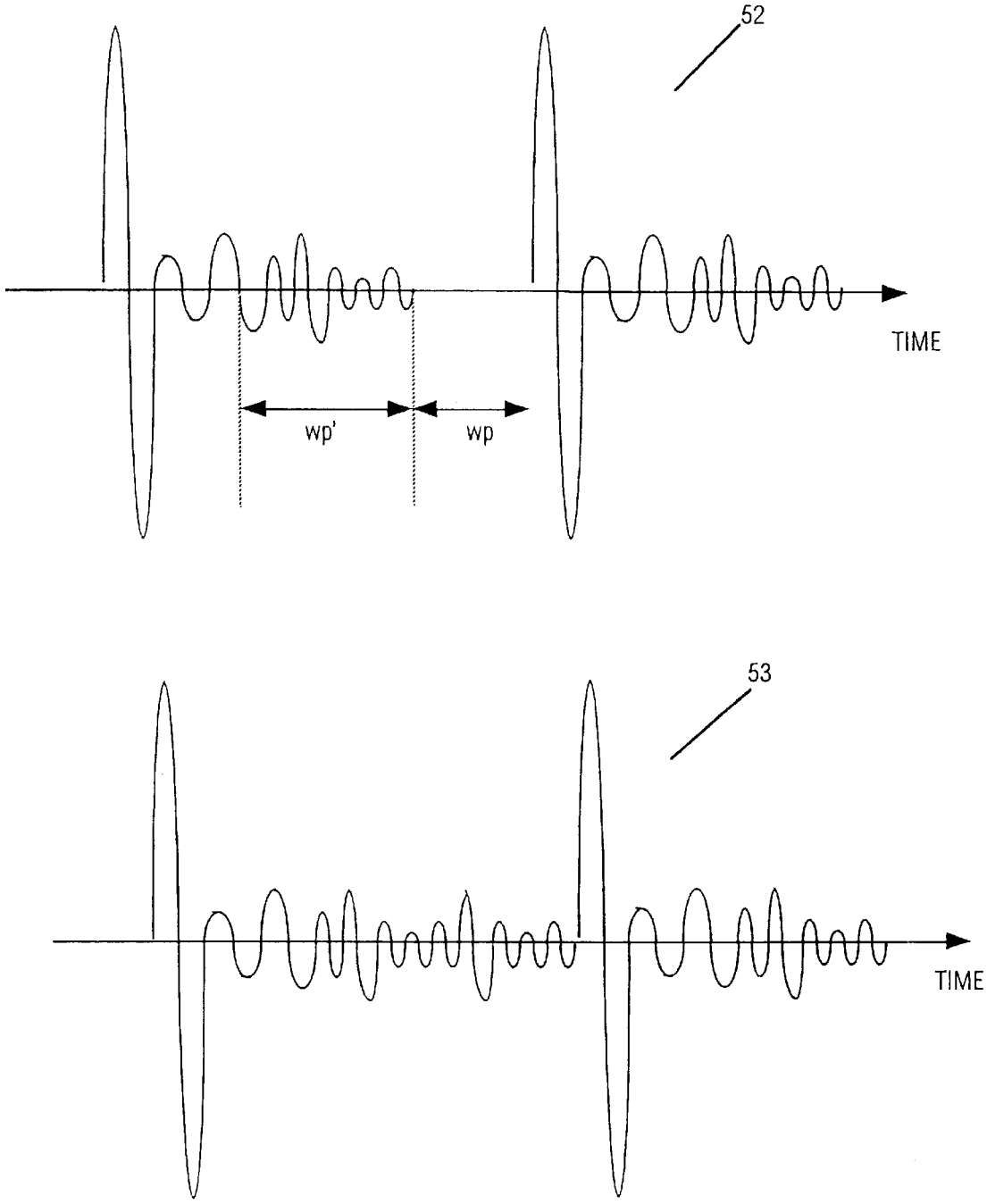
FIG. 4 is a diagram for illustrating processing which is executed when the interval between adjacent pitch waveform cycles is increased, as a result of waveform shaping executed with the first embodiment.

FIG. 4 illustrates the effect on a pitch waveform cycle of an acoustic waveform segment portion 52 which is subjected to an increase in pitch period, in step S5 of FIG. 2A as described above. As a result, a gap is formed within that pitch waveform cycle, with the gap duration (i.e., the amount of increase in pitch period) being designated as wp in FIG. 4. The gap can be eliminated to restore a continuous waveform for example by copying a portion of the existing waveform, having a duration wp' which which is longer than that of the gap, to overlap over each end of the gap, then applying oblique addition of pairs of overlapping sample values within these regions (as described hereinafter referring to FIG. 7) to achieve the result indicated by numeral 53.

If on the other hand that acoustic waveform segment portion is subjected to a decrease in pitch period, so that a region of waveform overlap of duration wp occurs within each of these pitch waveform cycles, each overlap region can be restored to a continuous waveform by processing the pairs of overlapping sample values within such a region as described above.

Figure 6:
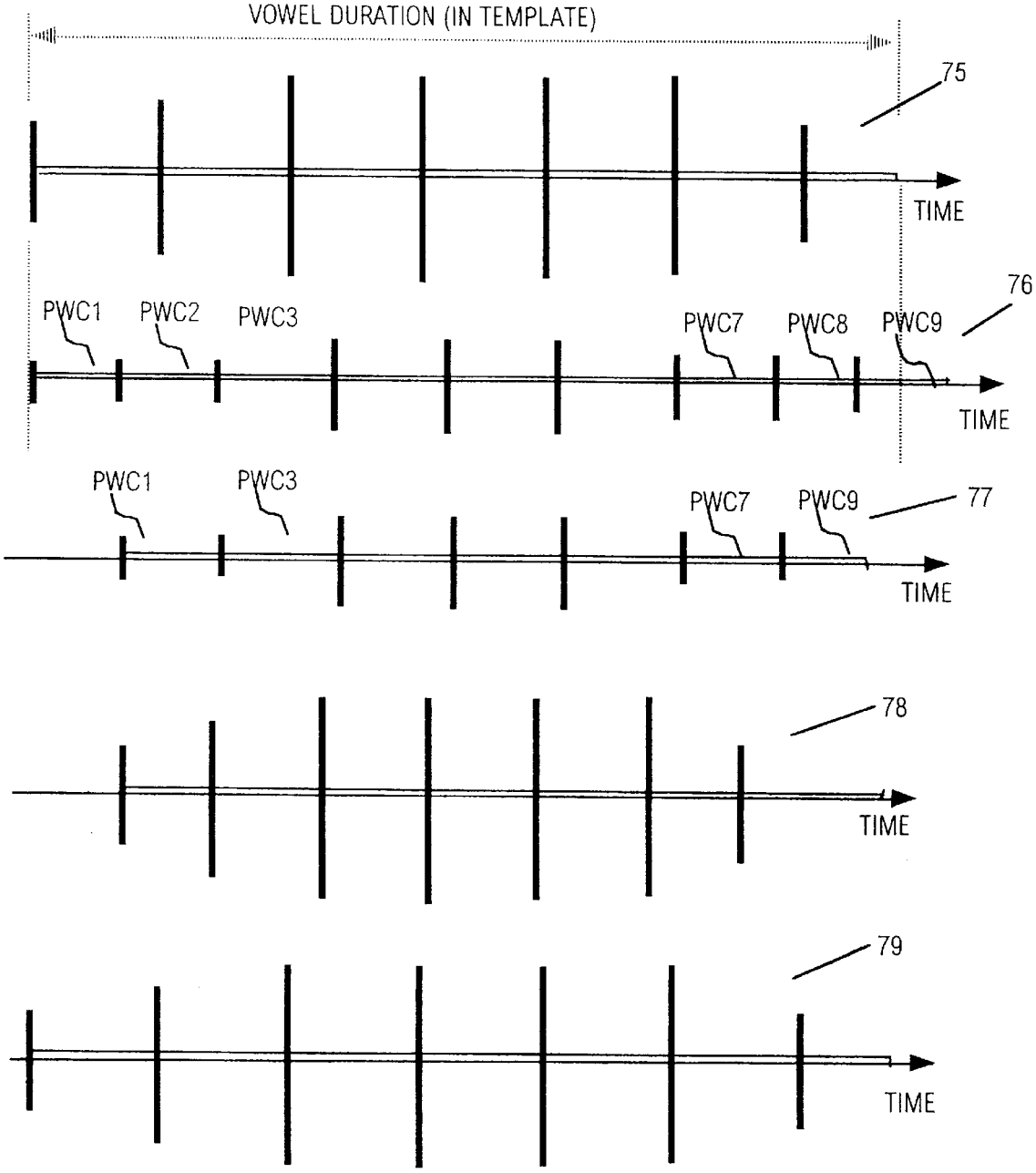
FIG. 6 is a timing diagram illustrating a process of reducing the duration of a vowel portion of an acoustic waveform segment, to match a corresponding vowel portion expressed by a prosodic template.
Figure 7:
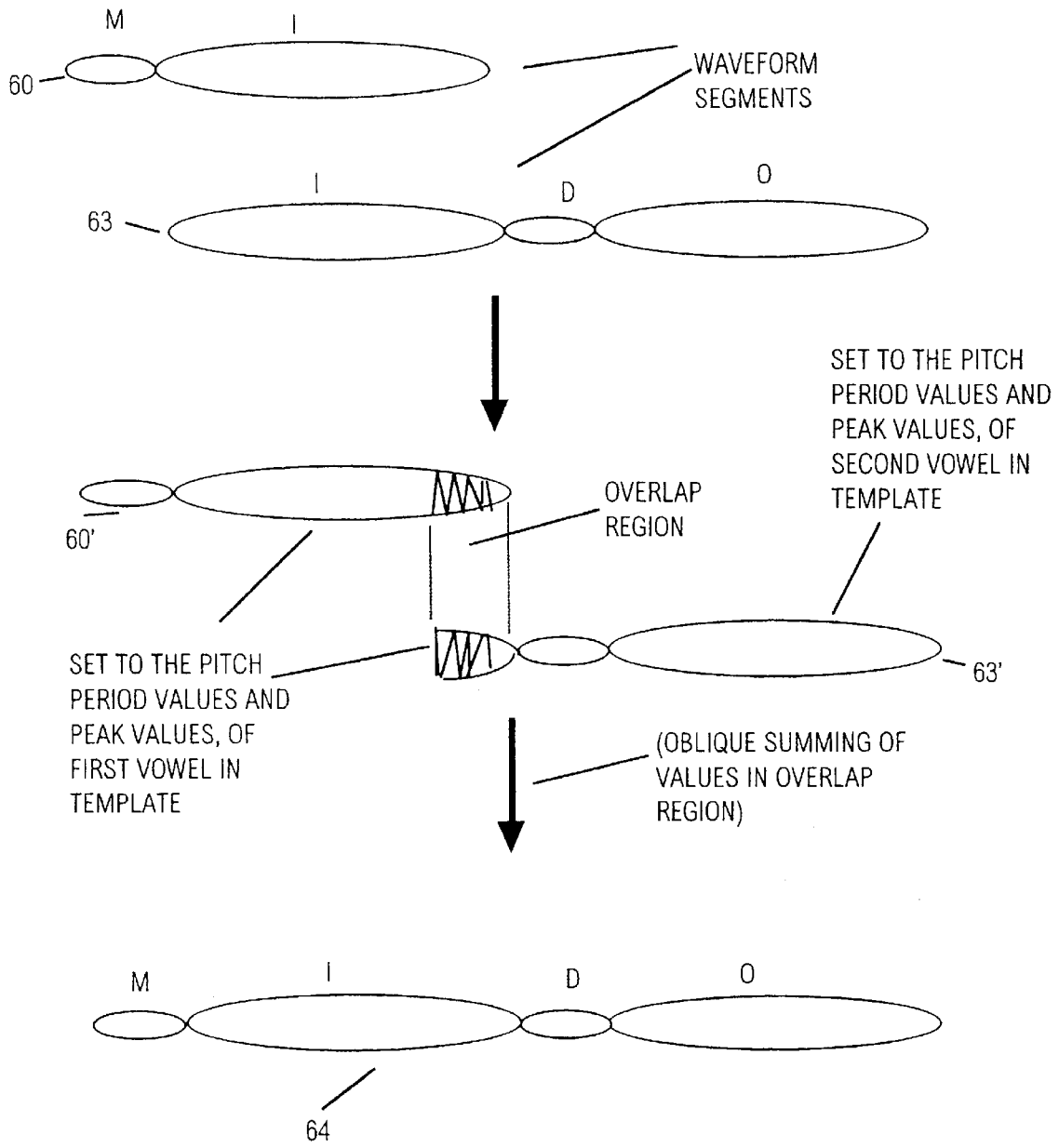
FIG. 7 is a conceptual diagram for illustrating a process of linking together two acoustic waveform segments to form a continuous waveform.

The operation executed in step S5 of FIG. 2A for the case in which the length of a vowel expressed in the selected set of acoustic waveform segments is greater than that of the corresponding vowel in the selected prosodic template is illustrated in very simplified form in FIG. 6, in which again the positions of peak value are indicated by the vertical lines. It is assumed in this example that a specific vowel expressed in the selected prosodic template consists of seven pitch waveform cycles, as indicated by numeral 75, and that the corresponding vowel expressed in the selected acoustic waveform segments is formed of nine pitch waveform cycles, as indicated by numeral 76. As indicated by numeral 77, the number of pitch waveform cycles constituting the vowel expressed by the acoustic waveform segment is first adjusted such as to approximately match the length of that vowel to the corresponding vowel duration that is expressed by the rythm data of the selected prosodic template, i.e., by decreasing the number of pitch waveform cycles to seven in this simple example. This decrease is performed by repetitively executing "thinning out" operations for successively removing pitch waveform cycles from this vowel portion of the acoustic waveform segment set. specifically, as indicated by numerals 76, 77, this is done by alternately removing pitch waveform cycles one at a time, first the second cycle from the start of the vowel, then the second cycle from the end, then the second from the start, and so on in succession until the necessary amount of reduction has been achieved. In this very simple example the pitch waveform cycles PWC2 and PWC8 are thereby eliminated. Adjustment of the peak value and of the pitch periods of that vowel expressed by the acoustic waveform segment set are then executed in steps S6, S7 as described hereinabove. on completion of step S7 of FIG. 2A, step S8 is executed in which the sequence of acoustic waveform segments which have been reshaped as described above are successively linked together. In describing this concatenation operation it will be assumed that phonetic labels of the successively overlapping type described hereinabove are utilized, i.e. of form [V or CV], [VCV, VCV, . . . VCV], [V]. Referring to the simplified conceptual diagram of FIG. 7, numeral 60 denotes the acoustic waveform segment which expresses the first phonetic label "mi" of the above speech item example "midorigaoka", while numeral 63 denotes the segment expressing the second phonetic label "ido". The "i" vowel portions of the segments 60, 63 are first each adjusted to match the speech power, duration and pitch frequency of the corresponding vowel of the selected prosodic template as described above referring to FIG. 2A. Respective parts of these two vowel portions of the resultant modified segments 60', 63' which correspond to an interval indicated as an "overlap region" in FIG. 7 are then combined, to thereby link the two waveform segments 60', 63'. This overlap region preferably has a duration of approximately 8 to 15 msec, i.e., corresponding to approximately three pitch waveform cycles. This combining operation is preferably performed by oblique summing of data samples of the two waveform segments, i.e., by an operation in which the respective data sample values y(n) generated by the operation can be expressed as:

$$y(n) = \sum_{i=0}^{N} (xp(N1 = n) \cdot ai + xf(n) \cdot (1 - ai)) / 1$$

where ai=1/N, xp represents data samples of the leading waveform segment and xf those of the trailing waveform segment, N1 is the number of the first data sample to be processed within the leading waveform segment (i.e., located at the start of the overlap region, in the example of FIG. 74) and the number of data samples constituting the overlap region is N.

This combining operation is successively repeated to link all of the acoustic waveform segments into a continuous waveform sequence.

Figure 2B:
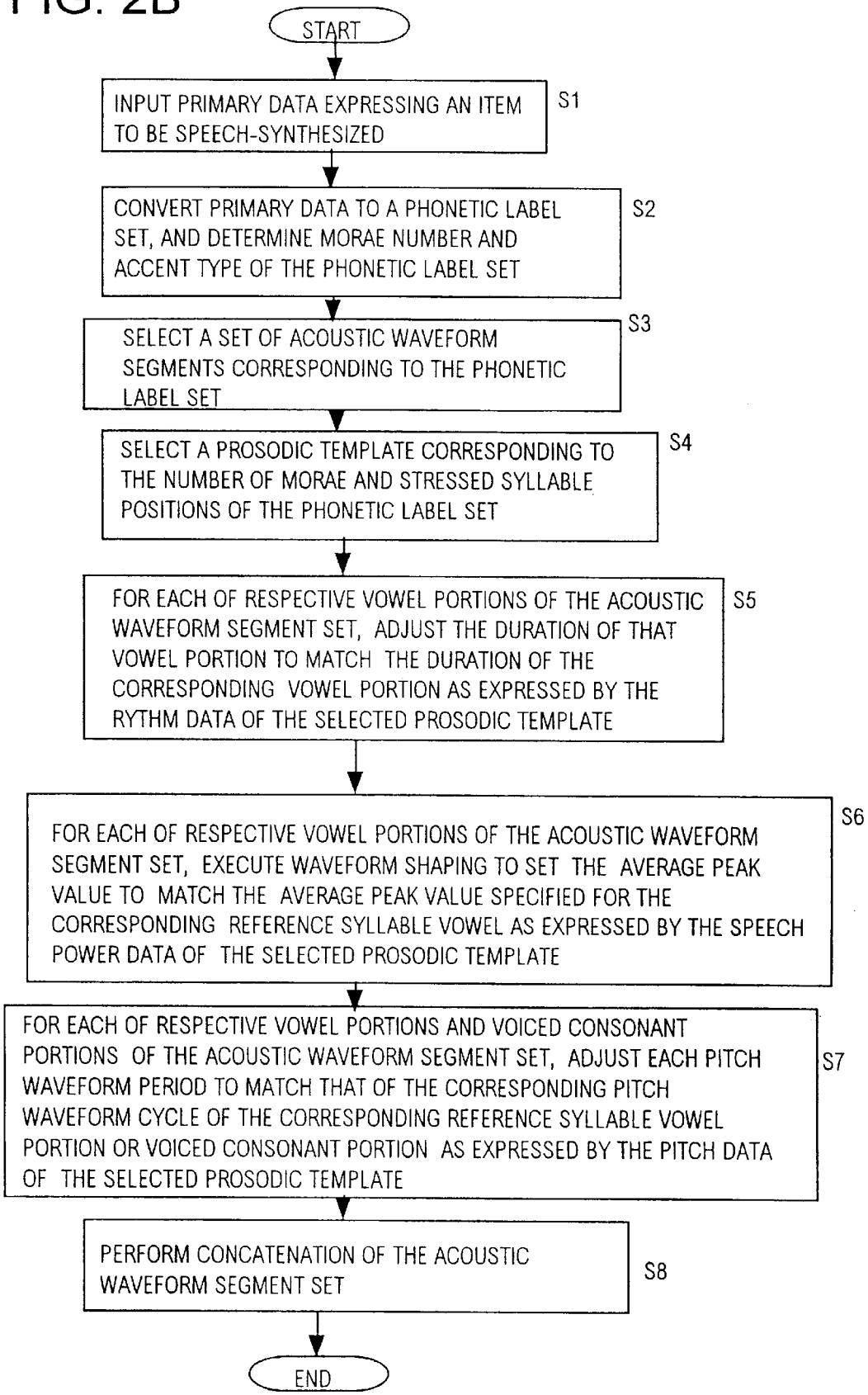
FIG. 2B is a flow diagram for an alternative form of the embodiment.

A modified form of this embodiment is shown in FIG. 2B, using a different method for matching the speech power of each vowel expressed by the acoustic waveform segments to that of the corresponding vowel expressed in the selected prosodic template. This is achieved by deriving the respective average values of speech power of respective vowels of the aforementioned enunciations of the reference syllable, and using these average values as the speech power data of a prosodic template. In that case, the peak values of a vowel expressed in the acoustic waveform segments are each adjusted to match the average peak value of the corresponding vowel as expressed by the speech power data of the selected prosodic template. It has been found that in some cases such a method of matching average speech power values can provide results that are audibly closer to the original speech sample used to generate the prosodic template.

Figure 8:
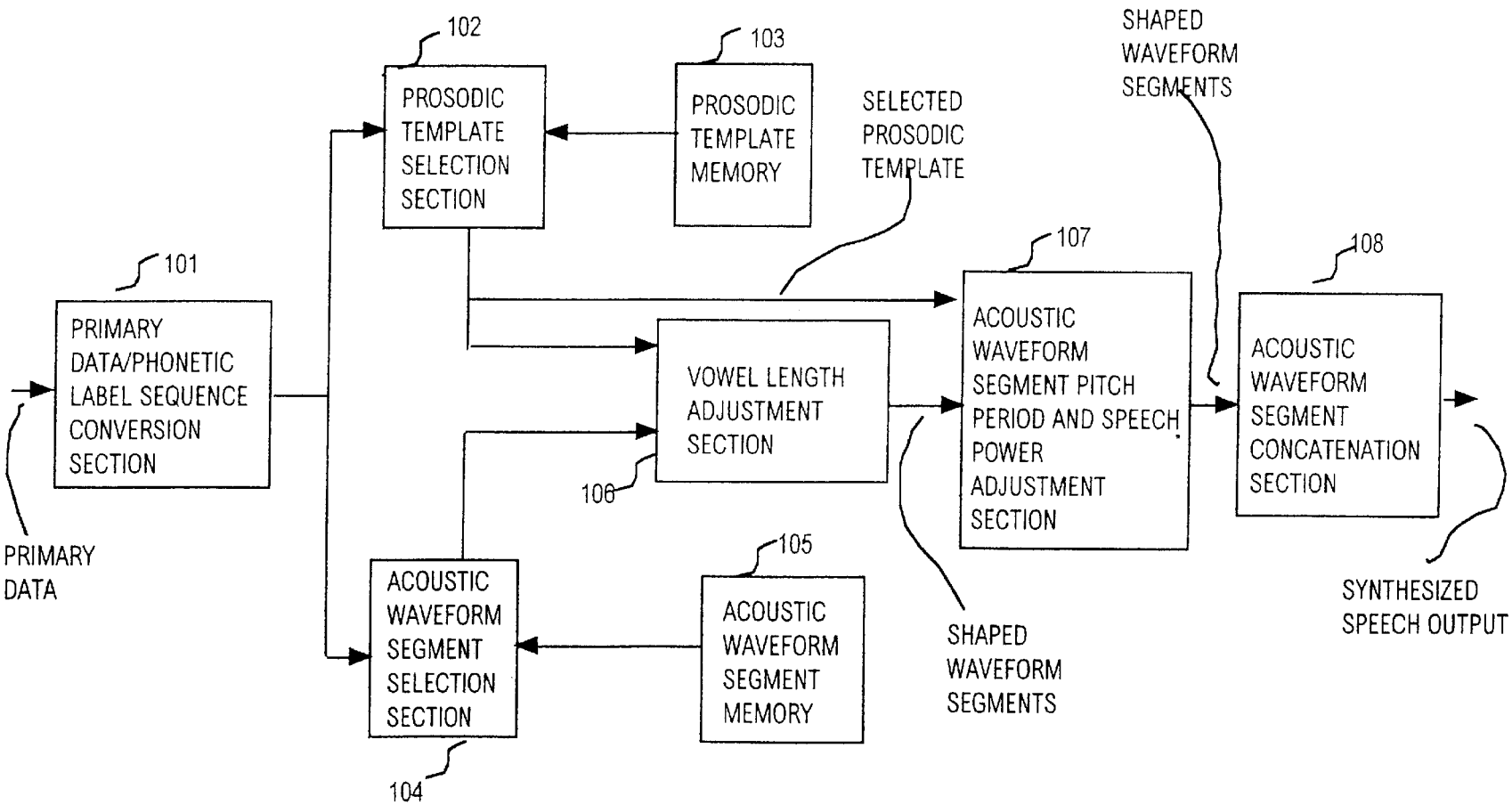
FIG. 8 is a general system block diagram of a speech synthesization apparatus for implementing the first embodiment of the invention.

FIG. 8 is a general system block diagram of an apparatus for implementing the first embodiment of a method of speech synthesis described above. The apparatus is formed of a primary data/phonetic label sequence conversion section 101 which receives sets of primary data expressing respective object speech items from an external source, a prosodic template selection section 102, a prosodic template memory 103 having a number of prosodic templates stored therein, an acoustic waveform segment selection section 104, an acoustic waveform segment memory 105 having a number of acoustic waveform segments stored therein, a vowel length adjustment section 106, an acoustic waveform segment pitch period and speech power adjustment section 107 and an acoustic waveform segment concatenation section 108.

Each apparatus for implementing the various embodiments of methods of the present invention has a basically similar configuration to that shown in FIG. 8. The central features of such an apparatus are, in addition to the prosodic template memory and a capability for selecting an appropriate prosodic template from that memory:

(a) a rythm adjustment section, which executes waveform shaping of a sequence of acoustic waveform segments expressing a speech item such as to bring the rythm close to that of the corresponding prosodic template, and (b) a pitch/speech power adjustment section which executes further waveform shaping of the acoustic waveform segments to bring the pitch and speech power characteristics of the speech item close to those of the prosodic template.

With the apparatus of FIG. 8, the vowel length adjustment section 107 constitutes the "rythm adjustment section", while the acoustic waveform segment pitch period and speech power adjustment section 108 constitutes the "pitch/speech power adjustment section".

In the prosodic template memory 103 of this embodiment, the rythm data set of each stored prosodic template consists of data specifying the respective durations of each of the successive vowel portions of the syllables of that prosodic template.

When a set of primary data expressing an object speech item is received, it is converted into a corresponding sequence of phonetic labels, by the primary data/phonetic label sequence conversion section 101. The primary data/phonetic label sequence conversion section 101 can for example be configured with a memory having various phonetic labels stored therein and also information for relating respective speech items to corresponding sequences of phonetic labels or for relating respective syllables to corresponding phonetic labels. A phonetic label sequence which is thereby produced from the primary data/phonetic label sequence conversion section 101 is supplied to the prosodic template selection section 102 and the acoustic waveform segment selection section 104. The prosodic template selection section 102 judges the received phonetic label sequence to determine the number of morae and accent type of the object speech item, and uses that information to select and read out out from the prosodic template memory 103 the data of a prosodic template corresponding to that phonetic label sequence, and supplies the selected prosodic template to the vowel length adjustment section 106 and to the acoustic waveform segment pitch period and speech power adjustment section 107.

The acoustic waveform segment selection section 104 responds to receiving the phonetic label sequence by reading out from the acoustic waveform segment selection section 104 data expressing a sequence of acoustic waveform segments corresponding to that phonetic label sequence, and supplying the acoustic waveform segment sequence to the vowel length adjustment section 106.

The vowel length adjustment section 106 executes reshaping of the acoustic waveform segments to achieve the necessary vowel length adjustments in accordance with the vowel length values from the selected prosodic template, as described hereinabove, and supplies the resultant shaped acoustic waveform segment sequence to the acoustic waveform segment pitch period and speech power adjustment section 107. The acoustic waveform segment pitch period and speech power adjustment section 107 then executes reshaping of the acoustic waveform segments to achieve matching of the pitch periods of respective pitch waveform cycles in each vowel and voiced consonant of the speech item expressed by that shaped acoustic waveform segment sequence to those of the corresponding pitch waveform cycles as expressed by the pitch data of the selected prosodic template, and also reshaping to achieve matching of the peak values of respective pitch waveform cycles of each vowel to the peak values of the corresponding pitch waveform cycles of the corresponding vowel as expressed by the speech power data of the selected prosodic template, as described hereinabove referring to FIG. 2A, (or alternatively, matching the peak values of each vowel to the average peak value of the corresponding vowel as specified in the prosodic template).

The resultant sequence of shaped acoustic waveform segments is then supplied by the acoustic waveform segment pitch period and speech power adjustment section 107 to the acoustic waveform segment concatenation section 108, which executes linking of successive acoustic waveform segments of that sequence to ensure smooth transitions between successive syllables, as described hereinabove referring to FIG. 7, and outputs the resultant data expressing the required synthesized speech.

Figure 9A:
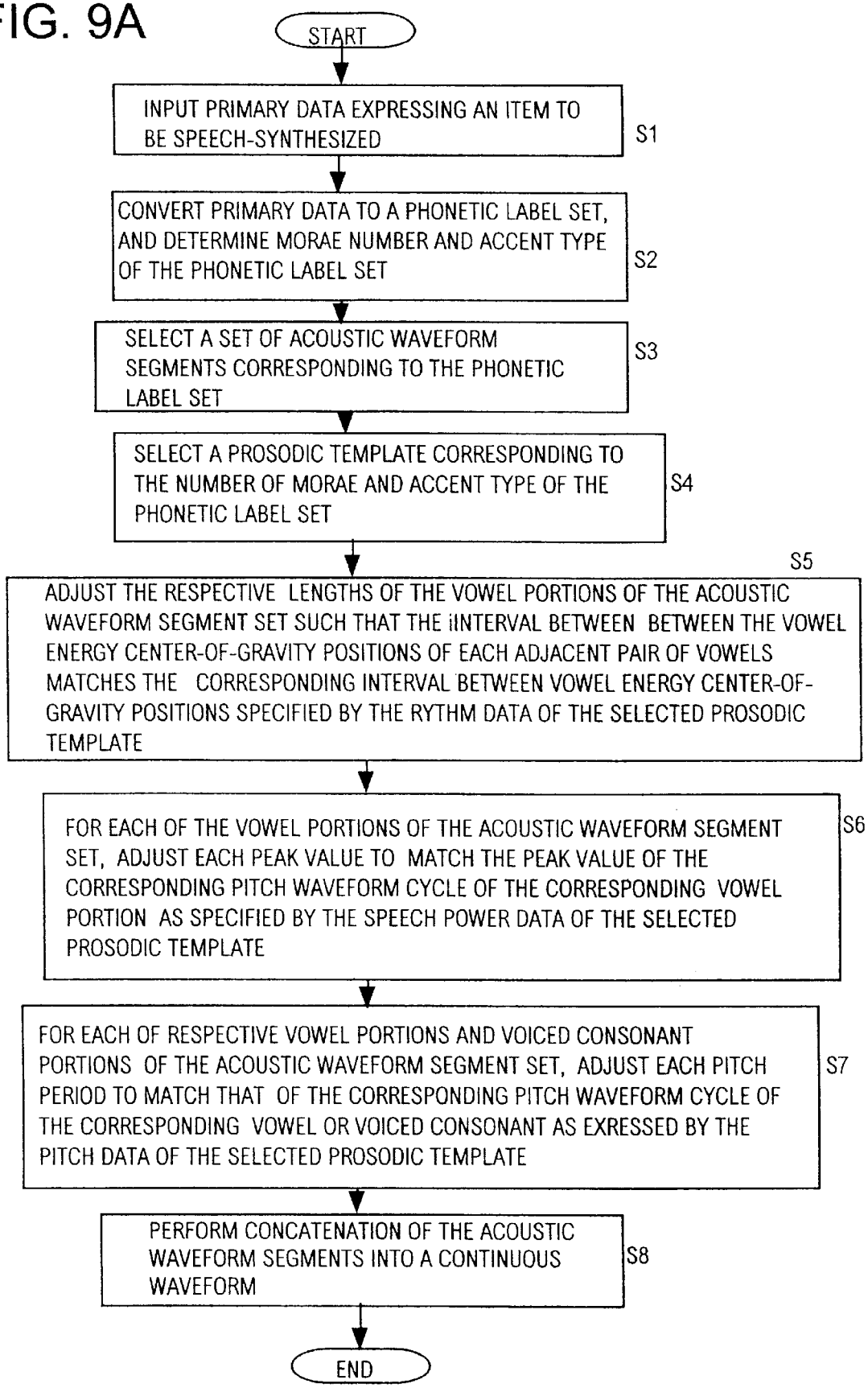
FIG. 9A is a flow diagram of the processing executed with a second embodiment of a method according to the present invention.

A second embodiment of the invention will be described referring to the flow diagram of FIG. 9A. The first four steps S1, S2, S3, S4 in this flow diagram are identical to those of FIG. 2A of the first embodiment described above. This embodiment differs from the first embodiment in that, in step S5 of FIG. 9A, instead of modifying each vowel expressed in the selected set of acoustic waveform segments to match the duration of the corresponding vowel expressed in the selected prosodic template as is done with the first embodiment, the interval between the respective vowel energy center-of-gravity positions of each pair of successive vowel portions in the acoustic waveform segment set is made identical to that of the corresponding interval between vowel energy center-of-gravity points of the two corresponding vowels, as expressed by the rythm data of the selected prosodic template.

Figure 10:
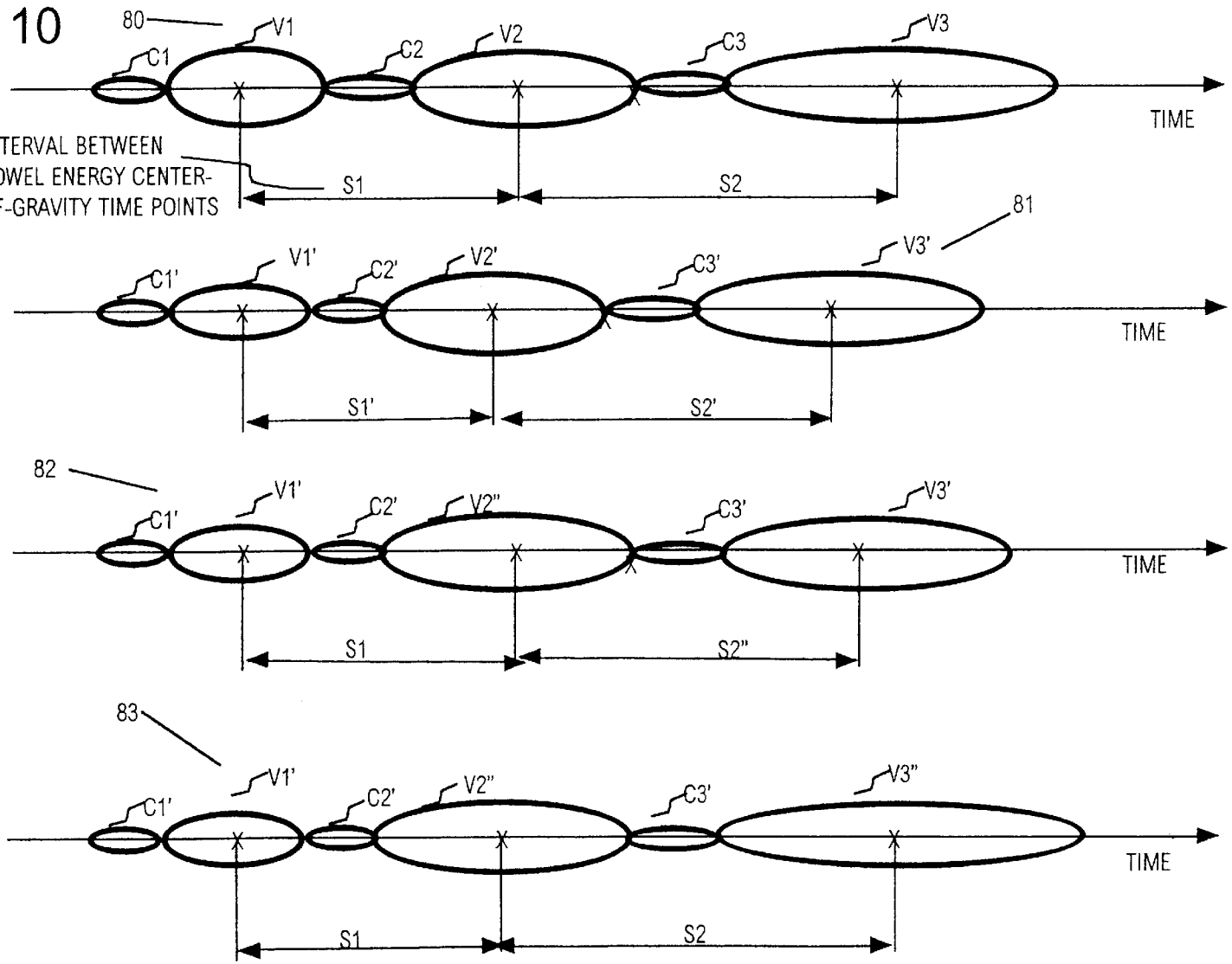
FIG. 10 is a timing diagram for illustrating the use of vowel energy center-of-gravity time points as reference time points for use in rythm adjustment, with the second embodiment.

This operation is conceptually illustrated in the simplified diagrams of FIG. 10. Reference numeral 80 indicates the first three consonant-vowel syllables of the selected prosodic template, designated as (C1, V1), (C2, V2), (C3, V3). The interval between the vowel energy center-of-gravity points of vowels V1, V2 is designated as S1, and that between the center-of-gravity points of vowels V2, V3 is designated as S2. Numeral 81 indicates the first three syllables (assumed here to be respective consonant-vowel syllables) of the set of selected acoustic waveform segments, designated as (C1', V1'), (C2', V2'), (C3', V3'). The interval between the vowel energy center-of-gravity points of vowels V1', V2' is designated as S1', and that between the center-of-gravity points of vowels V2', V3' is designated as S2'. In the case of the place name example "midorigaoka", V1' represents the waveform segment portion expressing the vowel "i" of the phonetic label "mi", and also that of the first vowel "i" of the phonetic label "ido", and S1' is the interval between the vowel energy center-of-gravity points of the first two vowels "i" and "o". Similarly, S2' is the interval between vowel energy center-of-gravity points of the second two vowels.

The length of the interval S1' is then adjusted to become identical to the interval S1 of the prosodic template. It will be assumed that this is done by increasing the number of pitch waveform cycles constituting the second vowel portion V2', to increase the duration of that portion V2' by an appropriate amount. This operation is executed as described hereinabove for the first embodiment referring to FIG. 5, by alternately copying the leading pitch waveform cycle of the vowel into a preceding position, copying the final pitch waveform cycle of the vowel into a final position and so on in succession, until the requisite amount of change in duration has been achieved. If on the other hand it were necessary to reduce the duration of portion V2' to achieve the desired result, this would be executed as described above referring to FIG. 6, by alternate operations of "thinning out" pitch waveform cycles from between the leading pitch waveform cycles then the final pitch waveform cycles of that vowel, in succession until the requisite duration is achieved.

The result is designated by numeral 82. The duration of the second vowel expressed by the acoustic waveform segment set has been adjusted to become as indicated by V2", such that the interval between the vowel energy center-of-gravity points of the vowel portions V1', V2" has become identical to the interval S1 between the vowel energy center-of-gravity points of the first two vowels of the selected prosodic template. The above operation is then repeated for the third vowel portion V3' of the acoustic waveform segment set, with the result being designated by reference numeral 83.

It can thus be understood that by sequential execution of such adjustment operations, the intervals between the vowel energy center-of-gravity points of each of successive pairs of vowel portions expressed by the selected acoustic waveform segment set can be made identical to the respective intervals between the corresponding pairs of vowel center-of-gravity points in the selected prosodic template.

The rythm data of each prosodic template of this embodiment specifies the durations of the respective intervals between adjacent pairs of vowel energy center-of-gravity points, in the sequence of enunciations of the reference syllable.

With the second embodiment, since it is ensured that the intervals between specific reference time points (i.e., vowel energy center-of-gravity points) located within each syllable of the speech item which is to be speech-synthesized, are made identical in duration to the corresponding intervals within the selected prosodic template, the rythm of the speech-synthesized speech item can be made close to that of the sample speech item used to derive the prosodic template, i.e., close to the rythm of natural speech.

Thus with the second embodiment, as for the first embodiment, the invention enables a prosodic template to be utilized for achieving natural-sounding synthesized speech, without the need for storage or processing of large amounts of data.

Figure 11:
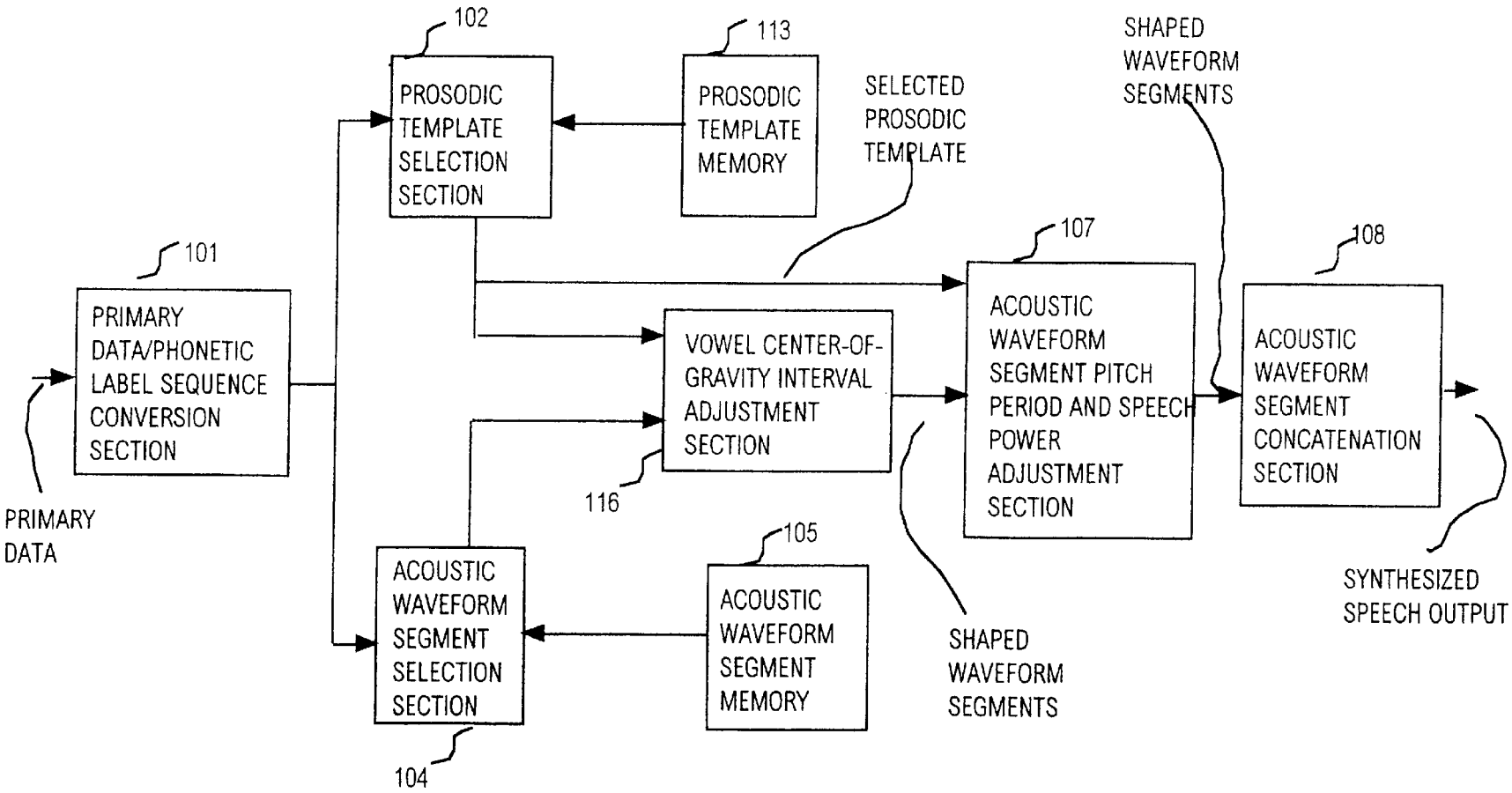
FIG. 11 is a general system block diagram of a speech synthesization apparatus for implementing the second embodiment of the invention.

FIG. 11 is a general system block diagram of an apparatus for implementing the second embodiment of a method of speech synthesis described above. The apparatus is formed of a a primary data/phonetic label sequence conversion section 101, a prosodic template selection section 102, a prosodic template memory 113 having a number of prosodic templates stored therein, an acoustic waveform segment selection section 104, an acoustic waveform segment memory 105 having a number of acoustic waveform segments stored therein, a vowel center-of-gravity interval adjustment section 116, an acoustic waveform segment pitch period and speech power adjustment section 107 and an acoustic waveform segment concatenation section 108. The configuration and operation of each of these sections other than the a vowel center-of-gravity interval adjustment section 116 are similar to the corresponding sections of the apparatus of FIG. 8, so that detailed description of these will be omitted. However the prosodic template 113 of this embodiment has stored therein, as the rythm data set of each prosodic template, data expressing the respective durations of intervals between vowel energy center-of-gravity points of adjacent pairs of vowels, as expressed by the rythm data of the prosodic template.

In FIG. 11, when primary data expressing a speech item that is to be speech-synthesized are received, the auditory perceptual timing point adjustment section 116 receives the data expressing a selected prosodic template from the prosodic template selection section 102 and data expressing the selected sequence of acoustic waveform segments from the acoustic waveform segment selection section 104, and executes shaping of requisite vowel portions of the acoustic waveform segments such as to match the intervals between the vowel energy center-of-gravity positions of these vowels to the corresponding intervals in the selected prosodic template, as described above referring to FIG. 10. The resultant shaped acoustic waveform segment sequence is supplied to the acoustic waveform segment concatenation section 118, to thereby obtain data expressing the requisite synthesized speech.

Figure 9B:
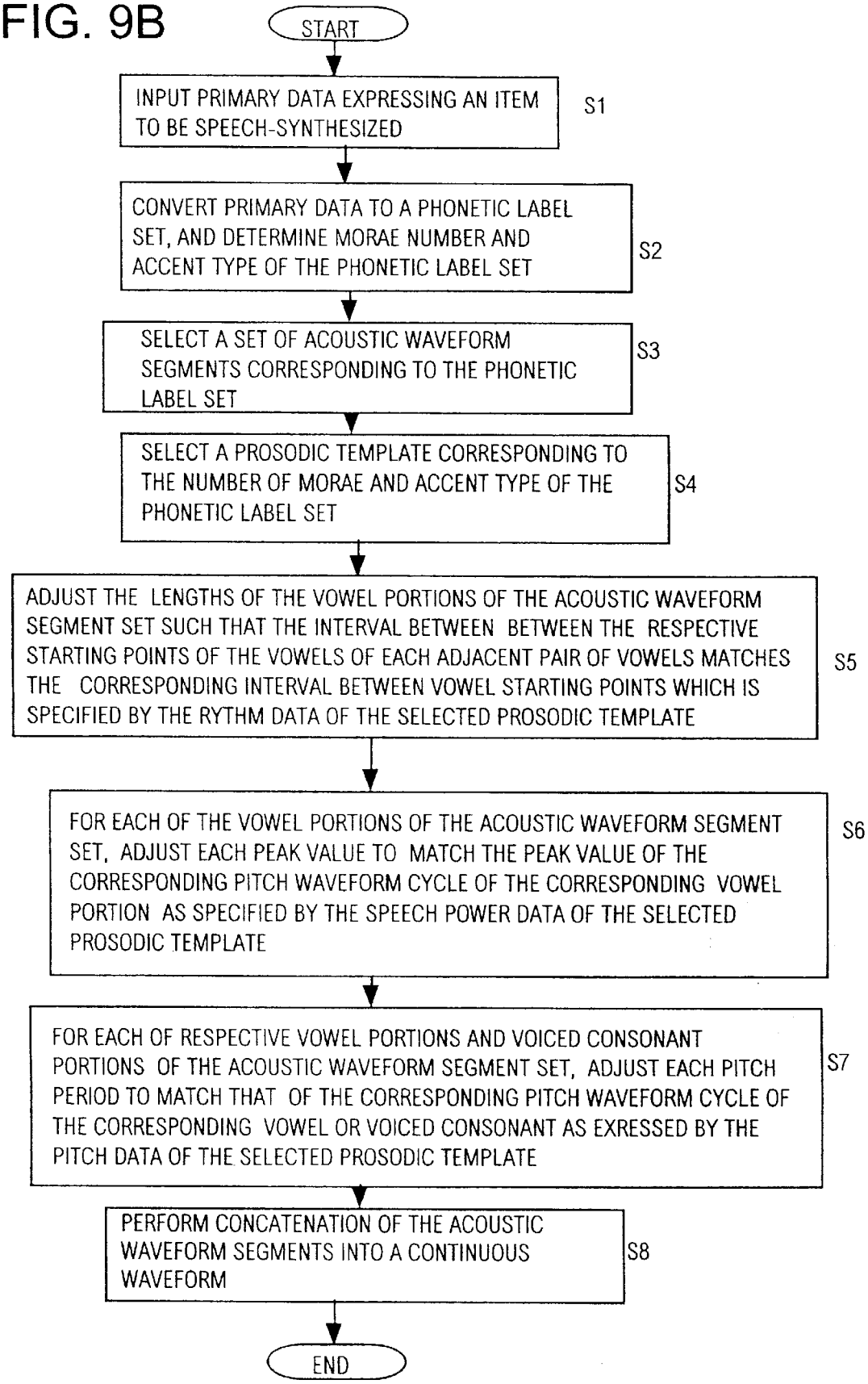
FIG. 9B is a flow diagram of an alternative form of that embodiment.

An alternative form of the second embodiment is shown in the flow diagram of FIG. 9B. Here, instead of using the vowel energy center-of-gravity points in the object speech item as reference time points, other points which each occur at some readily detectable position within each syllable are used as reference time points, in this case the starting point of each vowel. In that case, the interval between the starting points of each pair of adjacent vowels of the speech item expressed in the acoustic waveform segments would be adjusted, by waveform shaping of the acoustic waveform segments, to be made identical to the corresponding interval between vowel starting points which would be specified in the rythm data of the prosodic template.

That is to say, taking the simple example of FIG. 10, waveform shaping could be applied to the vowel V2' expressed by the acoustic waveform segments, such as to make the interval between the starting points of the vowels V1' and V2' identical to the interval between the starting points of the vowels V1 and V2 expressed by the prosodic template.

In that case, the rythm data set of each stored prosodic template would specify the respective intervals between the vowel starting points of successive pairs of vowel portions in the aforementioned sequence of reference syllable enunciations.

With the second embodiment described above, it is preferable that the first and final acoustic waveform segments be excluded from the operation of waveform adjustment of the acoustic waveform segments to achieve matching of intervals between reference time points to the corresponding intervals in the prosodic template. That is to say, taking for example the acoustic waveform segment sequence corresponding to "/mi/+/ido/+/ori/+/iga/+/ao/+/oka/+/a/", used for the word "midorigaoka" as described above, it is preferable that waveform adjustment to achieve interval matching is not applied to the interval between reference time points in the syllables "mi" and "do" of the segments /mi/ and /ido/.

A third embodiment of the invention will be described referring to the flow diagram of FIG. 12. The first four steps Sl, S2, S3, S4 in this flow diagram are identical to those of FIG. 2A of the first embodiment described above. With the third embodiment, the rythm data of each prosodic template expresses the durations of respective intervals between the auditory perceptual timing points of adjacent pairs of syllables, of the aforementioned sequence of enunciations of the refer syllable. The interval between the respective auditory perceptual timing points of each pair of adjacent vowels expressed in the sequence of acoustic waveform segments which is selected in accordance with the object speech item, as described for the previous embodiments, is adjusted to be made identical to that of the corresponding interval between auditory perceptual timing points that is specified in the rythm data of the selected prosodic template.

The concept of auditory perceptual timing points of syllables has been described in a paper by T. Minowa and Y. Arai, "The Japanese CV-Syllable Positioning Rule for Speech Synthesis", ICASSP86, Vol. 1, pp. 2031–2084 (1986). Basically, the auditory perceptual timing point of a syllable corresponds to the time point during enunciation of that syllable at which the syllable begins to be audibly recognized by a listener. Positions of the respective auditory perceptual timing points of various Japanese syllables have been established, and are shown in the table of FIG. 14.

Figure 13:
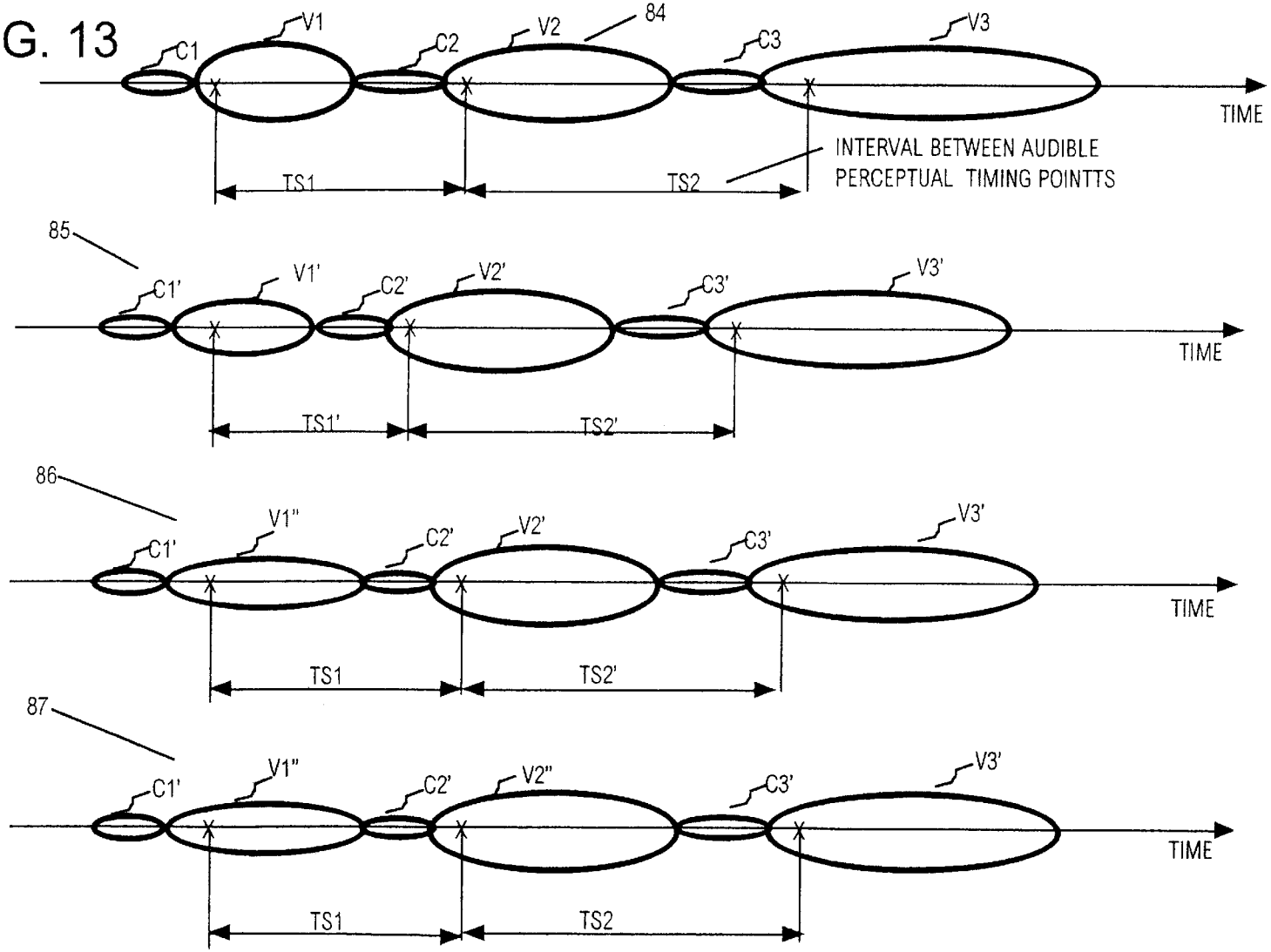
FIG. 13 is a timing diagram for illustrating the use of auditory perceptual timing points of respective syllables as reference time points for use in rythm adjustment, with the third embodiment.

The operation executed in step S5 of this embodiment is is conceptually illustrated in the simplified diagrams of FIG. 13. Here, reference numeral 84 indicates three successive consonant-vowel syllables of the selected prosodic template, designated as (C1, V1), (C2, V2), (C3, V3). The interval between the auditory perceptual timing points of the syllables (C1, V1) and (C2, V2) is designated as TS1, and that between the auditory perceptual timing points of the syllables (C2, V12) and (C3, V3) is designated as TS2.

Numeral 85 indicates the corresponding set of syllables of the selected set of acoustic waveform segments, as (C1', V1'), (C2', V2'), (C3', V3'). The interval between the auditory perceptual timing points of the syllables (C1', V1') and (C2', V2') is designated as TS1, and that between the auditory perceptual timing points of the syllables (C2', V12') and (C3', V3') is designated as TS2'. In the case of the place name example "midorigaoka" described hereinabove, (C1', V1') represents the waveform segment portion expressing the syllable "mi", (C2', V2') represents the waveform segment portion expressing the syllable "do", and (C3', V3') represents the waveform segment portion expressing the syllable "ri". TS1' designates the interval between the auditory perceptual timing points of the first and second syllables "mi" and "do", while TS2' is the interval between the auditory perceptual timing points of the second and third syllables "do" and "ri".

Numeral 86 indicates the results obtained by changing the interval between a successive pair of auditory perceptual timing points through altering vowel duration. In this example, since it is necessary to increase the auditory perceptual timing point interval TS1', the duration of the vowel V1' is increased, to become V1", such that TS1' is made equal to the interval TS1 of the prosodic template. The interval TS2' is then similarly adjusted by changing the length of the vowel portion V2', to obtain the results indicated by numeral 87, whereby the intervals between the auditory perceptual timing points of the syllables of the acoustic waveform segments have been made identical to the corresponding ones of the intervals which are specified by the rythm data of the selected prosodic template.

Increasing or decreasing of vowel duration to achieve such changes in interval between auditory perceptual timing points can be performed as described for the preceding embodiments, i.e., by addition of pitch waveform cycles to the leading and trailing ends of an acoustic waveform segment expressing the vowel, or by "thinning-out" of pitch waveform cycles from the leading and trailing ends of such a waveform segment.

Figure 12:
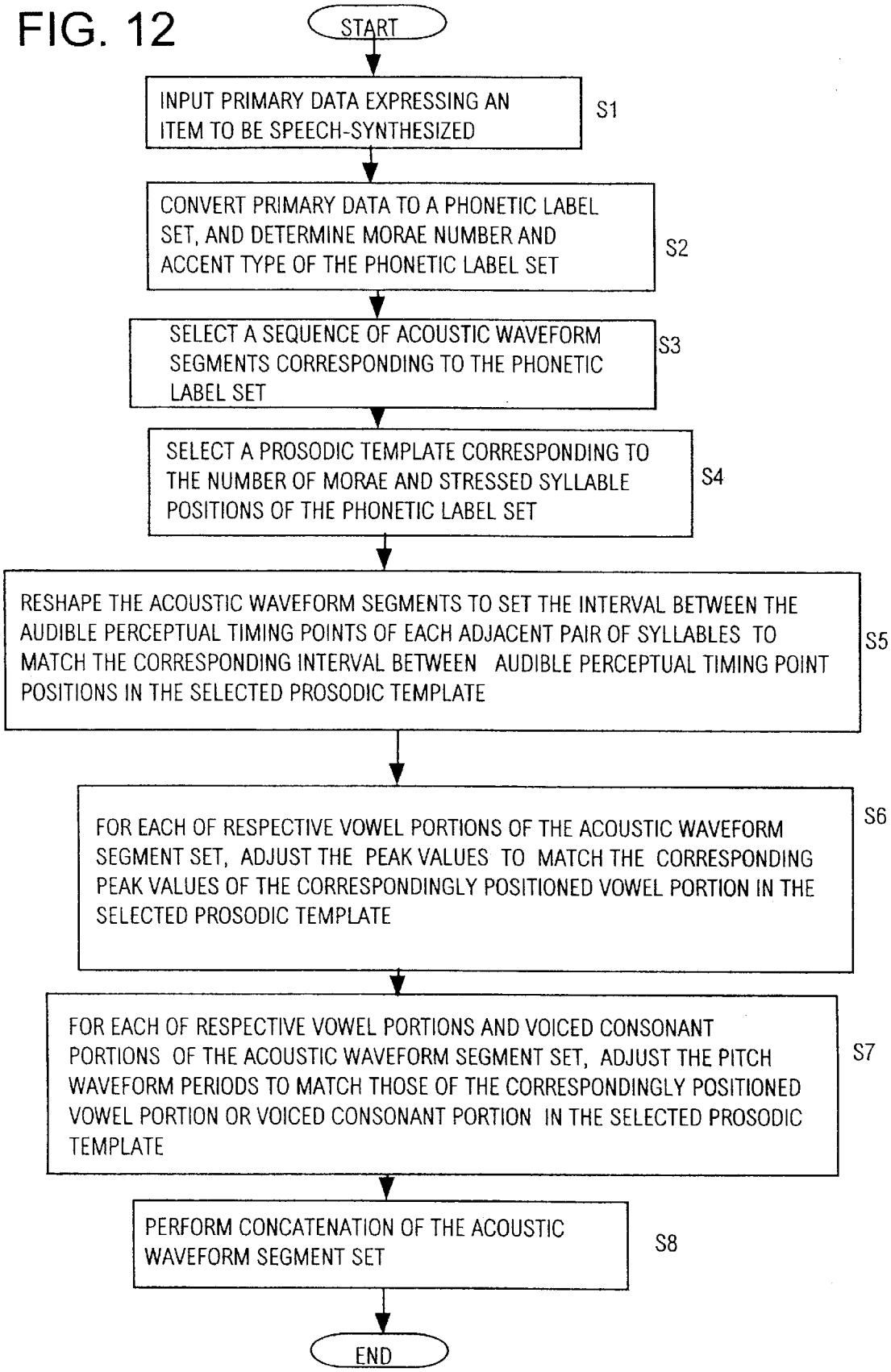
FIG. 12 is a flow diagram illustrating the sequence of processing operations of a third embodiment of a method of speech synthesization according to the present invention.

The remaining steps S6, S7 and S8 shown in FIG. 12 are identical to the correspondingly designated steps in FIG. 2A described above for the first embodiment, with steps S6 and S7 being applied to each vowel and each voiced consonant expressed by the acoustic waveform segments in the same manner as described for the first embodiment.

Figure 15:
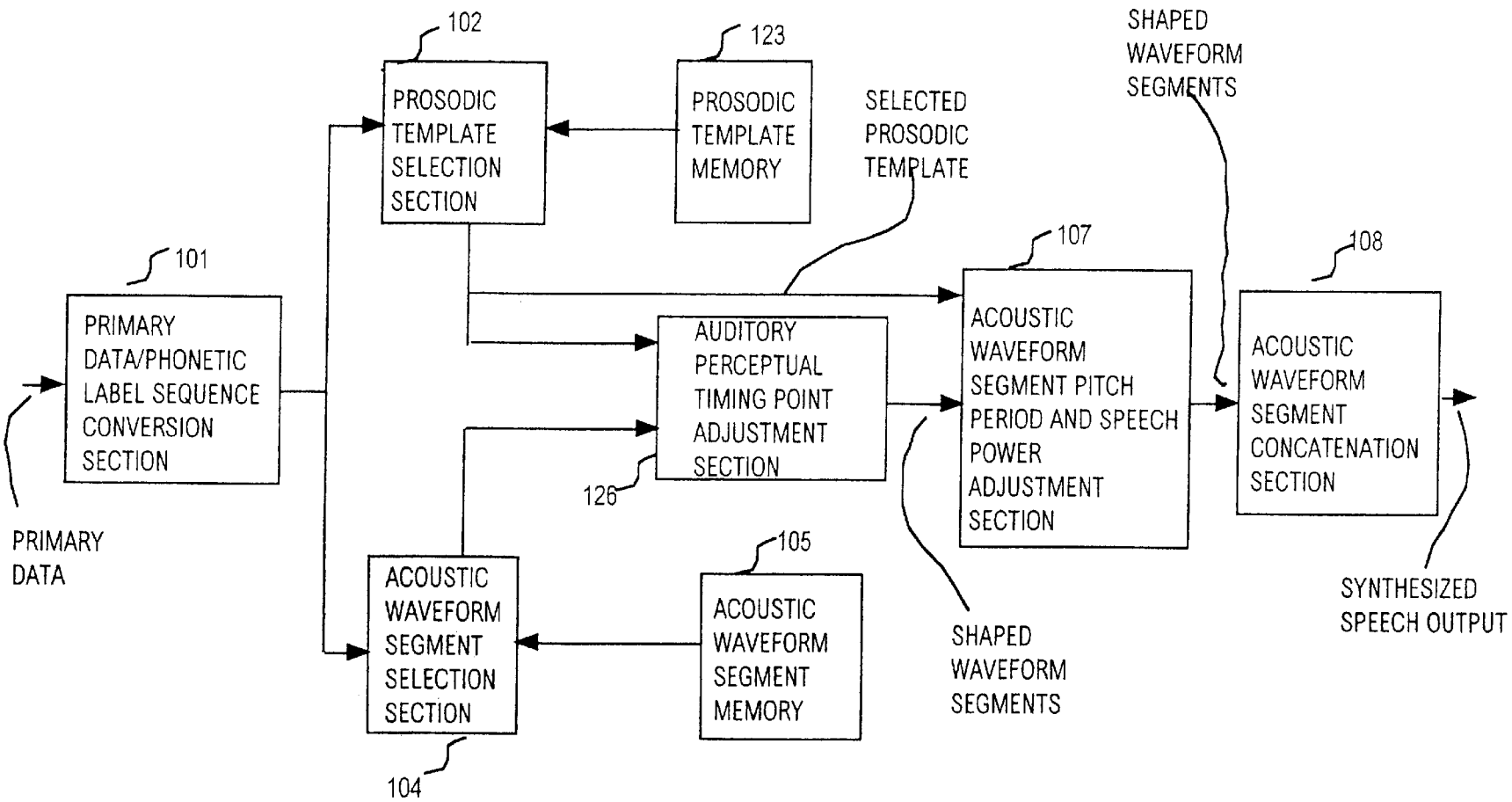
FIG. 15 is a general system block diagram of a speech synthesization apparatus for implementing the third embodiment of the invention.

FIG. 15 is a general system block diagram of an apparatus for implementing the third embodiment of a method of speech synthesis described above. The apparatus is formed of a a primary data/phonetic label sequence conversion section 101, a prosodic template selection section 102, a prosodic template memory 123 having a number of prosodic templates stored therein, an acoustic waveform segment selection section 104, an acoustic waveform segment memory 105 having a number of acoustic waveform segments stored therein, an auditory perceptual timing point adjustment section 126, an acoustic waveform segment pitch period and speech power adjustment section 107 and an acoustic waveform segment concatenation section 108. The configuration and operation of each of these sections other than the auditory perceptual timing point adjustment section 126 are similar to those of the respectively corresponding sections of the apparatus of FIG. 8, so that detailed description of these will be omitted. However with this embodiment, the rythm data set of each prosodic template stored in the prosodic template memory 123 expresses the respective durations of the intervals between the auditory perceptual timing points of each of adjacent pairs of template syllables.

In FIG. 15, when primary data expressing a speech item that is to be speech-synthesized are received, the auditory perceptual timing point adjustment section 126 receives the data expressing a selected prosodic template from the prosodic template selection section 102 and data expressing the selected sequence of acoustic waveform segments from the acoustic waveform segment selection section 104, and executes shaping of requisite vowel portions of the acoustic waveform segments such as to match the intervals between the auditory perceptual timing point positions of syllables expressed by the acoustic waveform segments to the corresponding interval that is specified in the rythm data of in the selected prosodic template, as described hereinabove referring to FIG. 13.

The resultant shaped acoustic waveform segment sequence is supplied to the acoustic waveform segment pitch period and speech power adjustment section 107, to be processed as described for the preceding embodiments, and the resultant reshaped waveform segments are supplied to the acoustic waveform segment concatenation section 128, to thereby obtain data expressing a continuous waveform which constitutes the requisite synthesized speech.

Figure 16A:
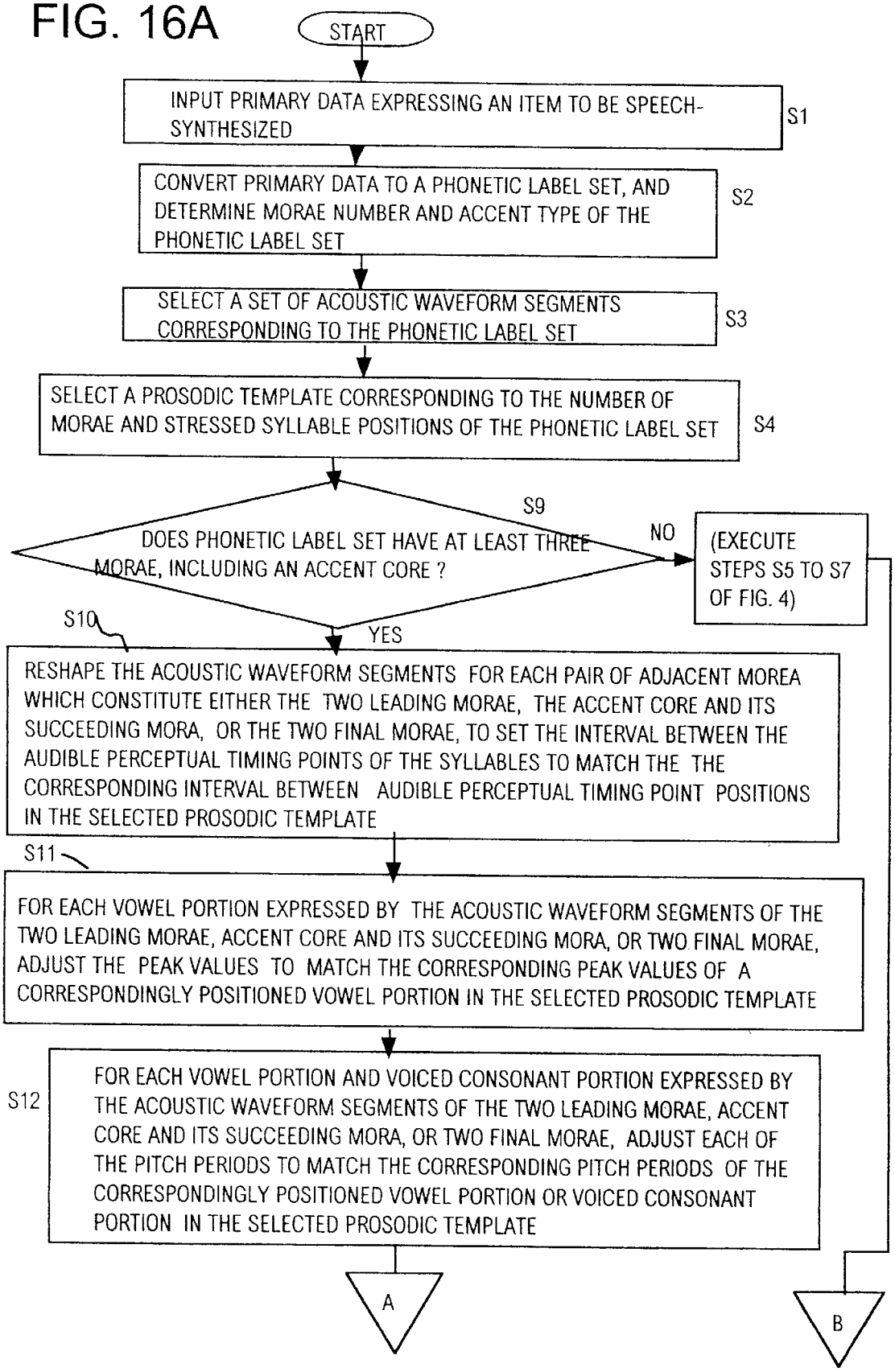
FIGS. 16A, 16B constitute a flow diagram illustrating the sequence of processing operations of a fourth embodiment of a method of speech synthesization according to the present invention.

A fourth embodiment of the invention will be described referring to the flow diagram of FIGS. 16A and 16B. Steps S1 to S4 of FIG. 16A are identical to the steps S1 to S4 of the first embodiment, with a phonetic label sequence, a corresponding sequence of acoustic waveform segments, and a prosodic template, being selected in accordance with the speech item which is to be synthesized. In the next step, designated as S9, a decision is made as to whether the speech item (and hence the selected phonetic label set) meets a condition of being formed of at least three morae, with one of these morae corresponding to an accented syllable (such a mora being referred to in the following as an accent core) If it is found that the speech item meets that condition, then the sequence of steps S10 to S14 is executed. If the speech item does not meet the above condition, then an identical sequence of steps to steps S5 to S7 of FIG. 12 described above is executed.

The purpose of the steps S10 to S14 is to apply interpolation processing within a speech item which satisfies the above condition, to each syllable that meets the condition of not corresponding to one of the two leading morae, or to the accent core or the immediately succeeding mora, or to one of the two final morae of the speech item.

The accent core may itself constitute one of the leading or final morae pairs. For example the Japanese place name "kanagawa" is formed as "ka na' ga wa", where "na" is an accent core, "ka na" constitute the two leading morae, and "ga wa" the two final morae.

If a "yes" decision is reached in step S9, step S10 is executed, in which the duration of one or both of the vowel portions expressed by the acoustic waveform segments for the two leading morae is adjusted such that the interval between the respective auditory perceptual timing points of the syllables of these two morae is made identical to the corresponding interval between auditory perceptual timing points that is specified by the rythm data of the selected prosodic template, with this adjustment being executed as described hereinabove for the preceding embodiment. Next, the same operation is executed to match the interval between the auditory perceptual timing points of the syllables of the accent core and the succeeding mora to the corresponding interval that is specified in the selected prosodic template. Vowel duration adjustment to match the interval between the auditory perceptual timing points of the syllables of the final two morae to the corresponding interval that is specified in the selected prosodic template is then similarly executed (if the final two morae do not themselves constitute the accent core and its succeeding mora).

Next, in step S11, peak amplitude adjustment is applied to the acoustic waveform segments of the vowel portions of the syllables of the two leading morae, accent core and its succeeding mora, and two final morae, to match the respective peak values to those of the corresponding vowel portions in the selected prosodic template as described for the preceding embodiments.

In step S12, pitch waveform period shaping is applied to the acoustic waveform segments of the vowel portions and voiced consonant portions of the syllables of the two leading morae, accent core and its succeeding mora, and two final morae, to match the pitch waveform periods within each of these segments to those of the corresponding part of the selected selected prosodic template, as described for the preceding embodiments.

Next, step S13 is executed in which, for each syllable expressed by the acoustic waveform segments which satisfies the above condition of not corresponding to one of the two leading morae, the accent core and its succeeding mora, or the two final morae, a position for the auditory perceptual timing point of that syllable is determined by linear interpolation from the respective auditory perceptual timing point positions that have already been established as described above. The duration of the vowel of that syllable is then then adjusted by waveform shaping of the corresponding acoustic waveform segment as described hereinabove, to set the position of the auditory perceptual timing point of that syllable to the interpolated position.

In step S14, the peak values of each such vowel are left unchanged, while each of the pitch periods of the acoustic waveform segment expressing the vowel are adjusted to values which are determined by linear interpolation from the pitch periods already derived for the syllables corresponding to the two leading morae, the accent core and its succeeding mora, and the two final morae.

Step S15 is then executed, to link together the sequence of shaped acoustic waveform segments which has been derived, as described for the preceding embodiments.

With this embodiment, taking for example the aforementioned place name "midorigaoka" which is formed of the morae sequence /mi/ /do/ /ri/ /ga/ /o'/ /ka/ as being the object speech item, where /o'/ denotes the accent core in that word, the appropriate interval between the auditory perceptual timing point positions of /mi/ and /do/ (which are the first two morae) would first be established, i.e., as the interval between the auditory perceptual timing ponts of the first two syllables of the selected template. The interval between the auditory perceptual timing point positions of /o'/ and /ka/ (which are the final two morae, and also are the accent core and its succeeding mora) would then be similarly set in accordance with the final two syllables of the template. Positions for the auditory perceptual timing points of /ri/ and /ga/ would then be determined by linear interpolation from the auditory perceptual timing point positions established for /mi/, /do/ and for /o'/, /ka/, and the respective acoustic waveform segments which express the syllables /ri/ and /ga/ would be reshaped to establish these interpolated positions for the auditory perceptual timing points. The respective pitch period values within the waveform segments expressing /ri/ and /ga/ would then be determined by linear interpolation using the values in the reshaped waveform segments of /mi/, /do/ and /o'/, /ka/. The peak values, i.e., the speech power of the syllables /ri/ and /ga/ would be left unchanged.

Figure 17:
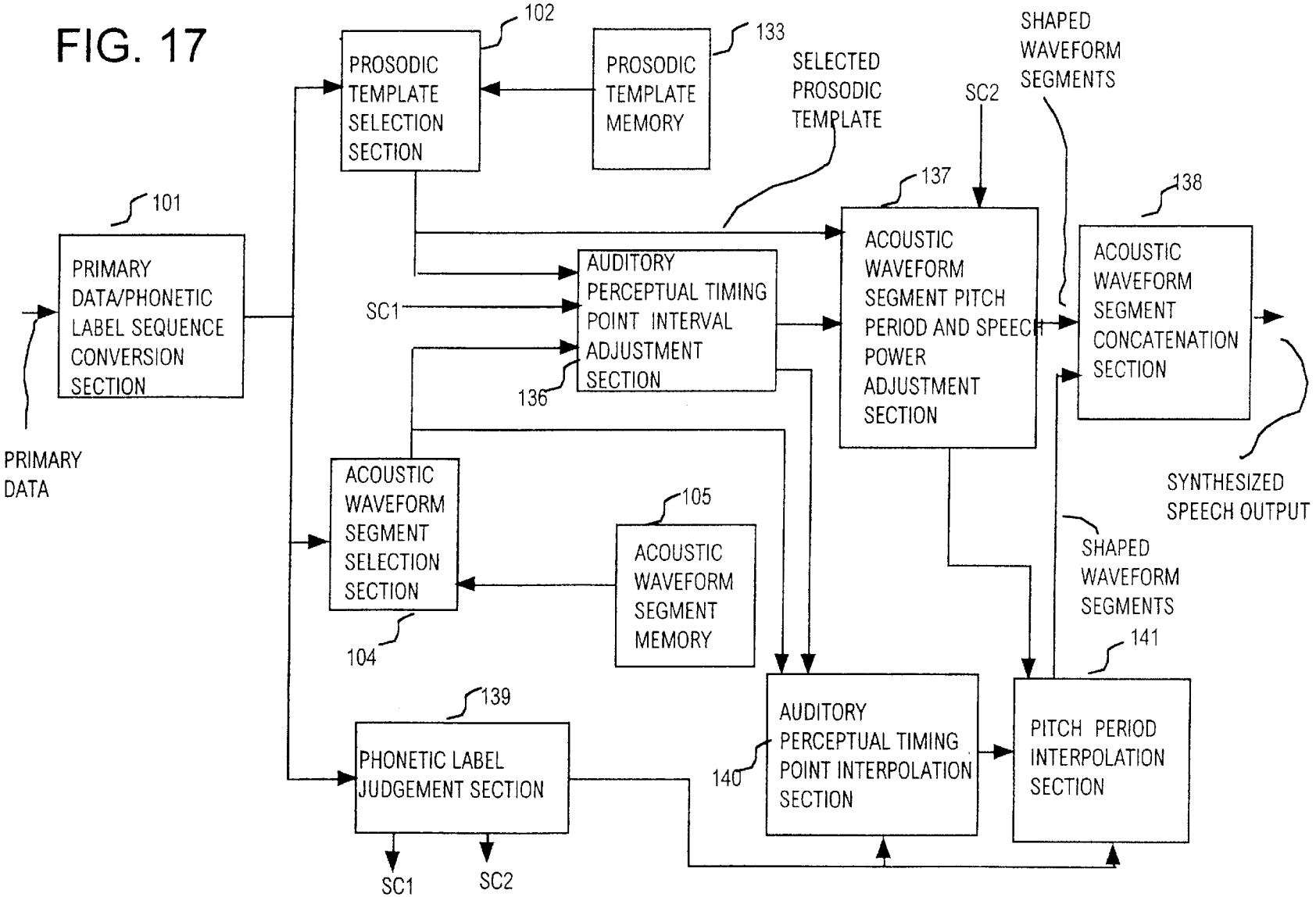
FIG. 17 is a general system block diagram of a speech synthesization apparatus for implementing the fourth embodiment of the invention.

FIG. 17 is a general system block diagram of an apparatus for implementing the fourth embodiment of a method of speech synthesis described above. The apparatus is formed of a primary data/phonetic label sequence conversion section 101, a prosodic template selection section 102, a prosodic template memory 133 having a number of prosodic templates stored therein, an acoustic waveform segment selection section 104, and an acoustic waveform segment memory 105 having a number of acoustic waveform segments stored therein, with the configuration and operation of each of these sections being similar to those of the corresponding sections of the preceding embodiments. In addition, the apparatus includes an auditory perceptual timing point adjustment section 136, an acoustic waveform segment pitch period and speech power adjustment section 137, an acoustic waveform segment concatenation section 138, a phonetic label judgement section 139, an auditory perceptual timing point interpolation section 140 and a pitch period interpolation section 141.

The phonetic label judgement section 139 receives the sequence of phonetic labels for a speech item that is to be speech-synthesized, from the primary data/phonetic label sequence conversion section 101, and generates control signals for controlling the operations of the acoustic waveform segment pitch period and speech power adjustment section 137, acoustic waveform segment concatenation section 138, auditory perceptual timing point interpolation section 140 and pitch period interpolation section 141. The auditory perceptual timing point interpolation section 140 receives the sequence of acoustic waveform segments for that speech item from the acoustic waveform segment selection section 134, and auditory perceptual timing point position information from the primary data generating section 130, and performs the aforementioned operation of determining an interpolated position for an auditory perceptual timing point of a syllable, at times controlled by the phonetic label judgement section 139.

More specifically, the phonetic label judgement section 139 judges whether or not the object speech item is formed of at least three morae including an accent core. If the phonetic label sequence does not meet that condition, then the phonetic label judgement section 139 does not perform any control function, and the auditory perceptual timing point adjustment section 136, acoustic waveform segment pitch period and speech power adjustment section 137 and acoustic waveform segment concatenation section 138 each function in an identical manner to the auditory perceptual timing point adjustment section 126, acoustic waveform segment pitch period and speech power adjustment section 107 and acoustic waveform segment concatenation section 108 respectively of the apparatus of FIG. 15 described above.

Figure 16B:
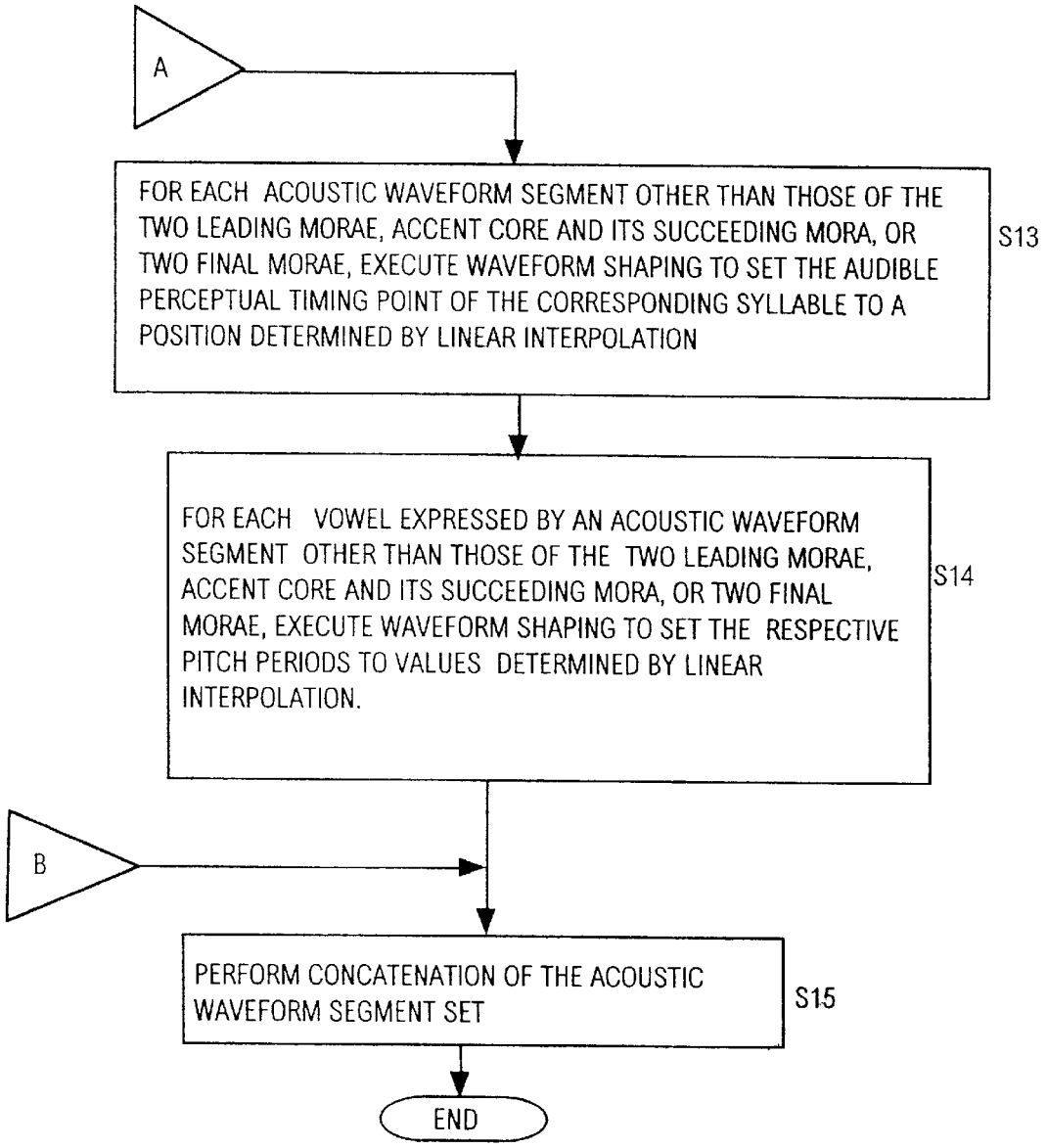

If the phonetic label judgement section 139 judges that object speech item, as expressed by the labels from primary data/phonetic label sequence conversion section 101 meets the aforementioned condition of having at least three morae including an accent core, then the label judgement section 139 generates a control signal SC1 which is applied to the auditory perceptual timing point adjustment section 136 and has the effect of executing vowel shaping for the sequence of acoustic waveform segments such that each interval between the auditory perceptual timing points of each adjacent pair of syllables which correspond to either the two leading morae, the accent core and its succeeding mora, or the two final morae, is matched to the corresponding interval in the selected prosodic template, as described hereinabove referring to FIGS. 16A, 16B. The resultant shaped sequence of acoustic waveform segments is supplied to the acoustic waveform segment pitch period and speech power adjustment section 137, to which the phonetic label judgement section 139 applies a control signal SC2, causing the acoustic waveform segment pitch period and speech power adjustment section 137 to execute further shaping of the sequence of acoustic waveform segments such that for each syllable which corresponds to one of the two leading morae, the accent core and its succeeding mora, or the two final morae, the pitch periods of voiced consonants and vowels and the peak value of vowels are respectively matched to those of the corresponding vowels and voiced consonants of the prosodic template, as described hereinabove referring to FIGS. 16A, 16B.

In addition, in this condition, the phonetic label judgement section 139 applies control signals to the auditory perceptual timing point interpolation section 140 and pitch period interpolation section 141 causing the auditory perceptual timing point interpolation section 140 to utilize auditory perceptual timing point information, supplied from the auditory perceptual timing point adjustment section 136, to derive an auditory perceptual timing point position for each syllable which does not meet the condition of being a syllable of one of the two leading morae, the accent core and its succeeding mora, or the two final morae, by linear interpolation from auditory perceptual timing point position values which have been established by the auditory perceptual timing point adjustment section 136 for the other morae, as described hereinabove, and to then execute vowel shaping of such a syllable to set its auditory perceptual timing point position to that interpolated position.

The resultant modified acoustic waveform segment for such a syllable is then supplied to the pitch period interpolation section 141, which also receives information supplied from the acoustic waveform segment pitch period and speech power adjustment section 137, expressing the peak value and pitch period values which have been established for the other syllables by the acoustic waveform segment pitch period and speech power adjustment section 137. The pitch period interpolation section 141 utilizes that information to derive interpolated pitch period values and peak value, and executes shaping of the waveform segment received from the auditory perceptual timing point interpolation section 140 to establish these interpolated pitch period values and peak value for the syllable that is expressed by that acoustic waveform segment.

Each of the shaped waveform segments which are thereby produced by the pitch period interpolation section 141 and the shaped waveforms segments which are produced from the acoustic waveform segment pitch period and speech power adjustment section 137, are supplied to the acoustic waveform segment concatenation section 138, to be combined in accordance with the order of the original sequence of waveform segments produced from the acoustic waveform segment selection section 134, and then linked to form a continuous waveform sequence as described for the preceding embodiments, to thereby obtain data expressing the requisite synthesized speech.

With this embodiment the prosodic template memory 133 has stored therein, in the case of each prosodic template which has been derived from a sample speech item meeting the above condition of having at least three morae including an accent core, data expressing speech power value, pitch period values and auditory perceptual timing point intervals, for only certain specific syllables, i.e., for each syllable which satisfies the condition of corresponding to one of the two leading morae, or to the accent core or its succeeding mora, or to one of the two final morae.

Figure 18:
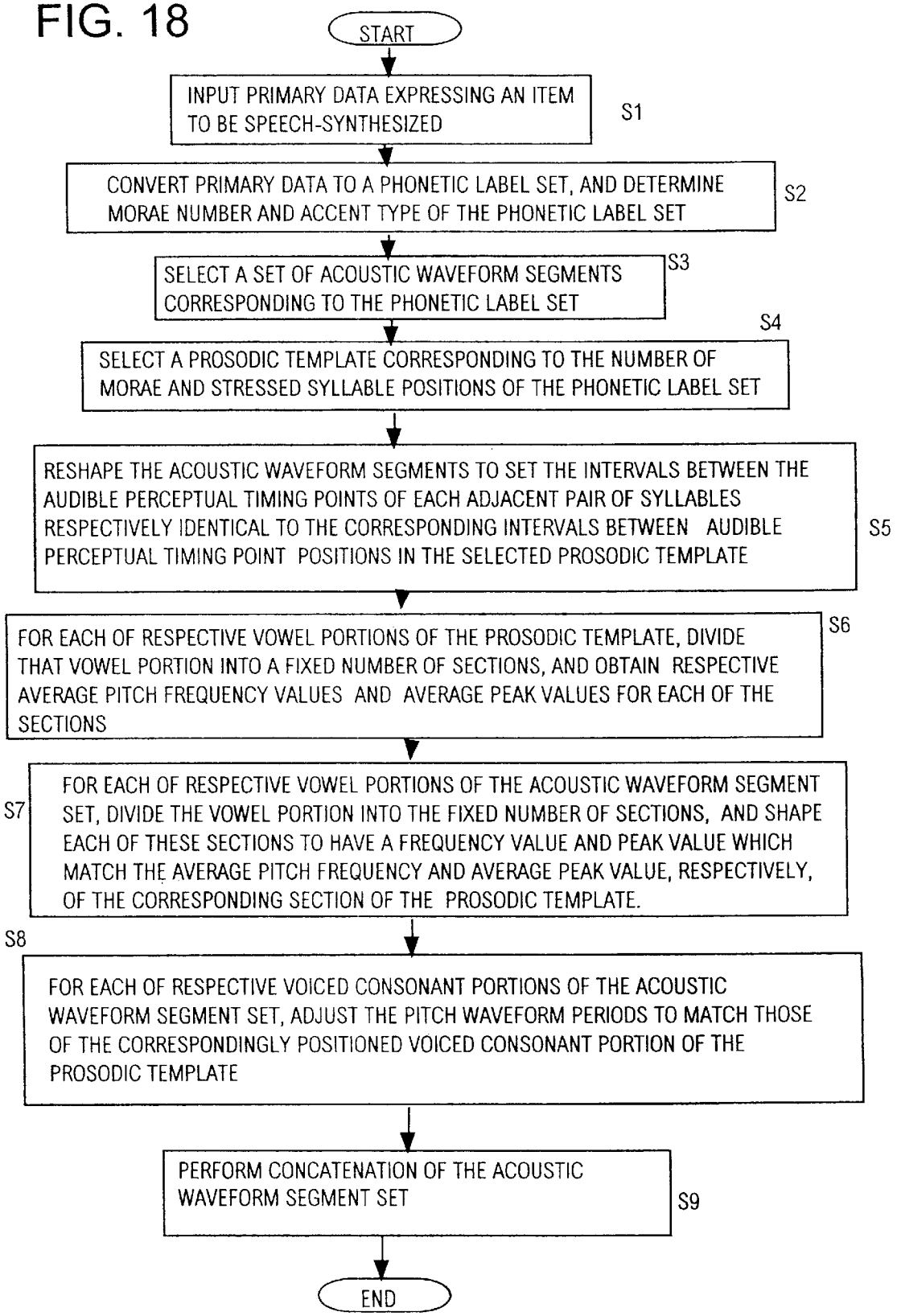
FIG. 18 is a flow diagram illustrating the sequence of processing operations of a fifth embodiment of a method of speech synthesization according to the present invention.
Figure 19A:
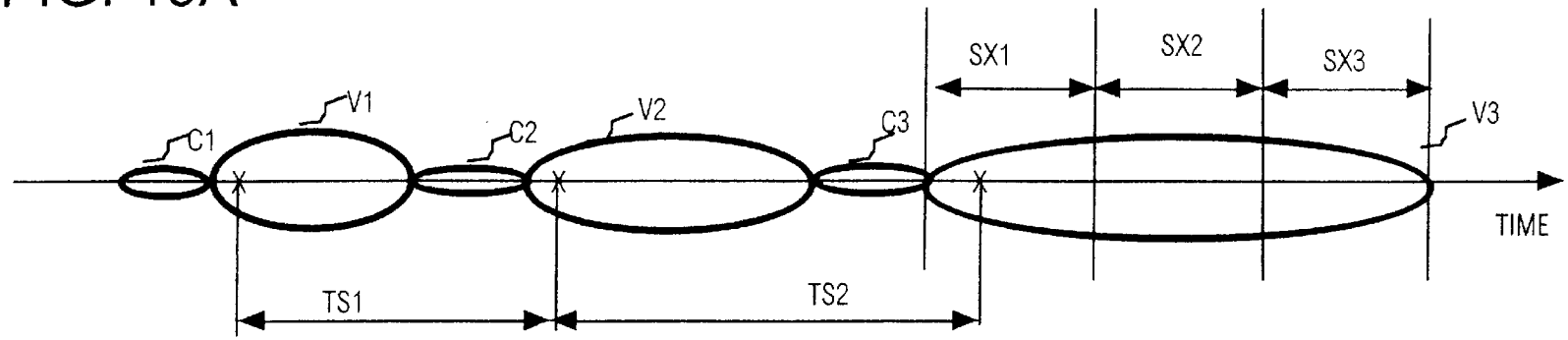
FIGS. 19A, 19B are timing diagrams for illustrating the use of average values of speech power and pitch period derived for respective sections of each vowel portion of each syllable of a prosodic template, for adjusting the speech power and pitch characteristics of an object speech item to those of the template.
Figure 19B:
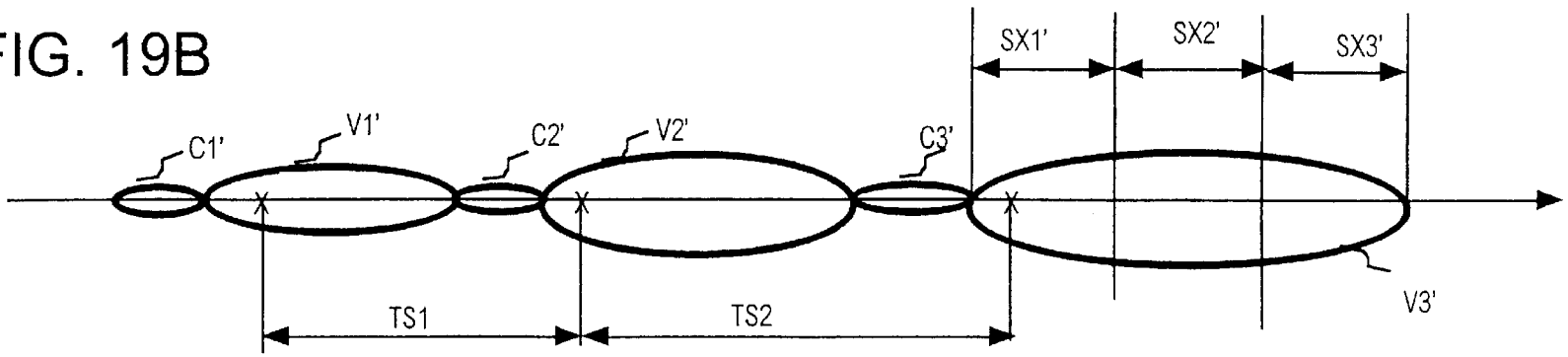

A fifth embodiment of the invention will be described referring to the flow diagram of FIG. 18. Steps S1 to S5 in FIG. 18 are identical to the correspondingly designated steps in FIG. 12 for the third embodiment described above, with a prosodic template and a sequence of acoustic waveform segments being selected in accordance with the speech item that is to be speech-synthesized, and with vowel portions of the acoustic waveform segments being modified in shape such as to match the intervals between successive auditory perceptual timing points of syllables expressed by the sequence of acoustic waveform segments to the corresponding intervals in the selected prosodic template. In the next step S6 in FIG. 18, each of the vowel portions of the selected prosodic template is divided into a fixed number of sections (preferably either 3 or 4 sections), and the respective average values of pitch waveform cycle period within each of these sections of each vowel are obtained. The respective averages of the peak values of the pitch waveform cycles within each of these sections are also obtained. This is conceptually illustrated in the simplified diagrams of FIGS. of 19A and 19B which respectively show the leading part of a selected prosodic template and leading part of a selected sequence of acoustic waveform segments, with FIG. 19B showing the acoustic waveform segments after these have been modified in shape to make the intervals TS1, TS2 between auditory perceptual timing points of pairs of adjacent syllables identical to the corresponding intervals in the selected prosodic template, as described hereinabove for the third embodiment. Each vowel expressed by the prosodic template is divided into three sections, as illustrated for the sections SX1, SX2, SX3 of vowel portion V3. The respective average values of pitch period within each of the sections SX1 to SX3 are first derived, then the respective average peak values are obtained for each of the sections SX1 to SX3.

In the following step S7, each of the vowel portions of the acoustic waveform segment sequence is divided in the aforementioned number of sections. Each of these sections is then subjected to waveform shaping to make the value of pitch period throughout that section identical to the average value of pitch period obtained for the corresponding section of the corresponding vowel expressed in the selected prosodic template. Each of these sections of a vowel expressed in the acoustic waveform segment sequence is then adjusted in shape such that the peak values throughout that section are each made identical to the average peak value that was obtained for the corresponding section of the corresponding vowel expressed in the selected prosodic template.

That is, in the example of FIGS. 10A, 10B, vowel portion V3' of the shaped sequence of acoustic waveform segments is divided into three sections SX1', SX2', SX3'. The respective periods of the pitch waveform cycles within the section SX1' are then adjusted to be made identical to the average value of pitch period of the corresponding section, SX1, of the corresponding vowel V3, in the template. Such adjustment can be executed for a vowel section by successive copying of leading and trailing pitch waveform cycles or "thinning-out" of pitch waveform cycles within the section SX1', in the same way as has been described hereinabove referring to FIGS. 4, 5 and 6 for the case of adjusting the shape of an entire vowel. The respective peak value of the pitch waveform cycles within the section SX1' are then adjusted to be made identical to the average peak value of the pitch waveform cycles in section SX1 of vowel V3 expressed in the template.

The same process is executed for each of the other sections SX2', SX3' of vowel V3', and for each of the other vowel portions in the sequence of acoustic waveform segments.

In the next step S8, the consonant portions of the waveform segment sequence are treated as follows. If a consonant portion, such as C3' in FIG. 19B, is that of a voiced consonant, then the values of the pitch waveform cycle periods within that portion are modified to be made identical to those of the corresponding portion in the selected template, e.g., C3 in FIG. 19A, while the peak values are left unchanged. However if the consonant portion is that of an unvoiced consonant, then the values of the pitch waveform cycle periods and also of the peak values are left unmodified.

Linking of the successive segments of the shaped acoustic waveform segment sequence is then executed in step S9, as described hereineabove for the first embodiment.

Figure 20:
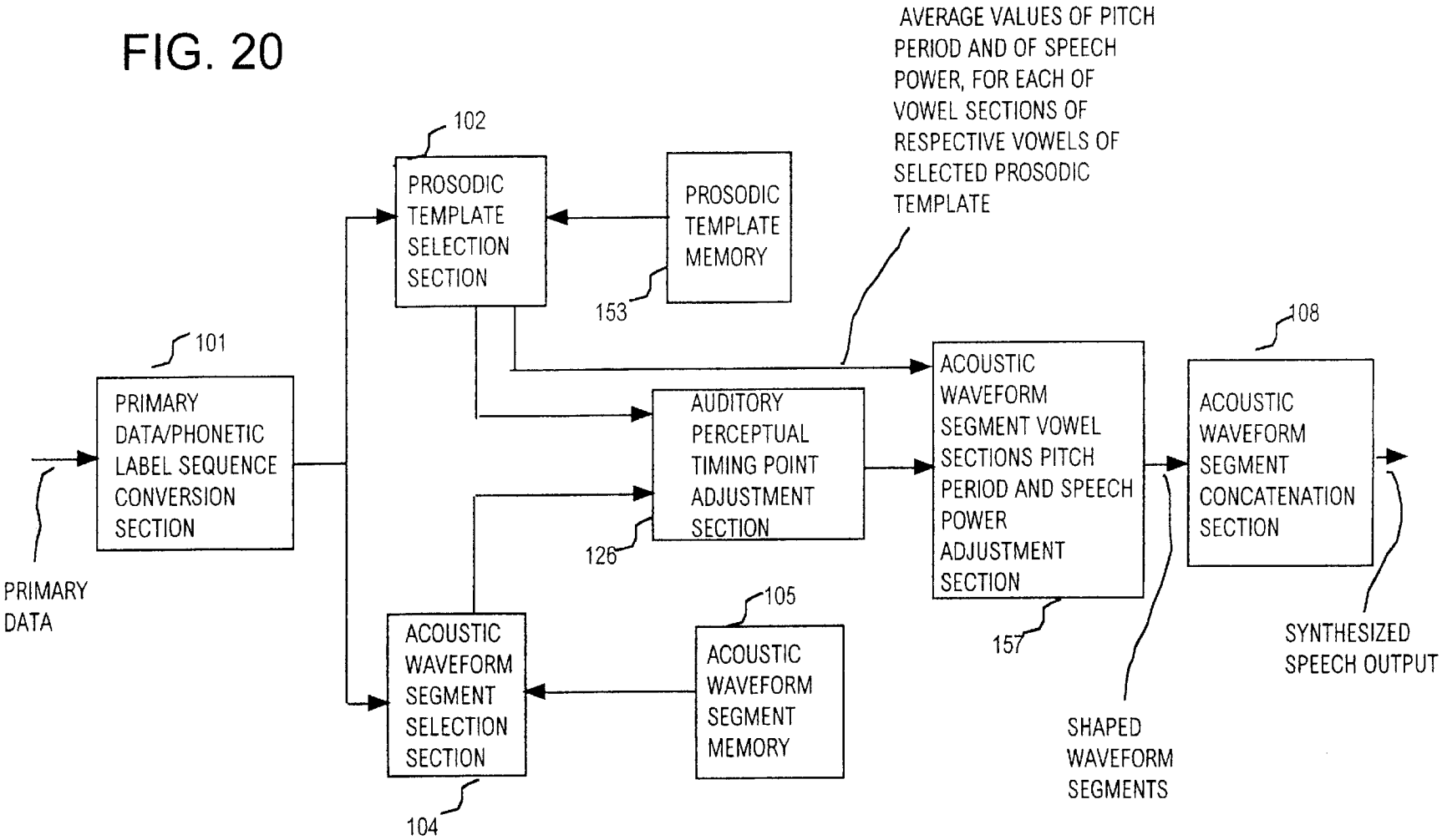
FIG. 20 is a general system block diagram of a speech synthesization apparatus for implementing the fifth embodiment of the invention.
Figure 21:
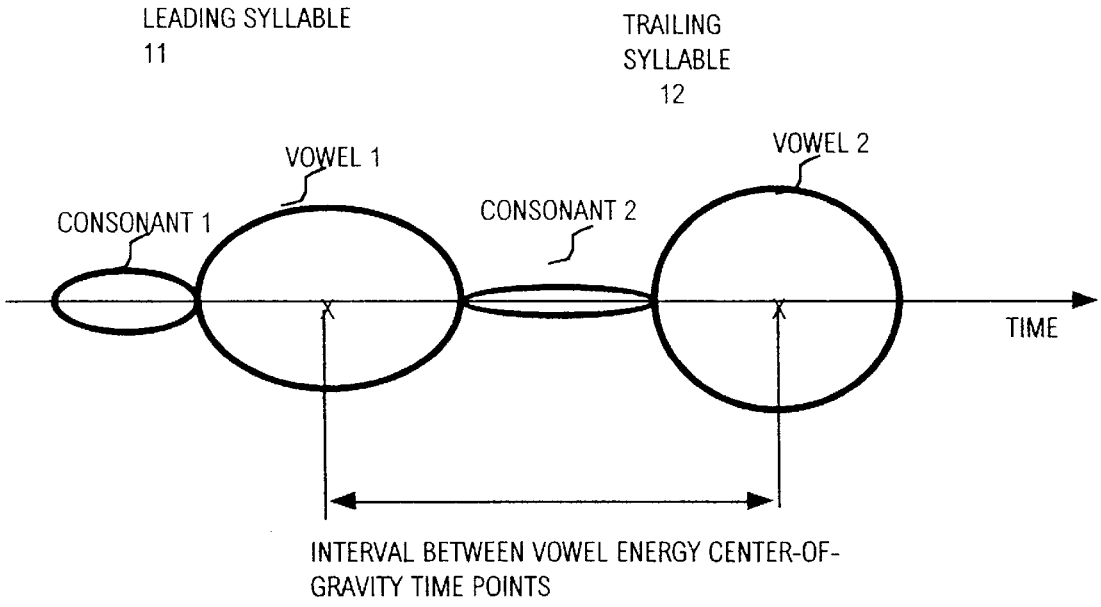
FIG. 21 PRIOR ART
FIG. 21 is a diagram for illustrating the use of intervals between vowel center-of-gravity points, with a first example of a prior art method of speech synthesization.
Figure 22:
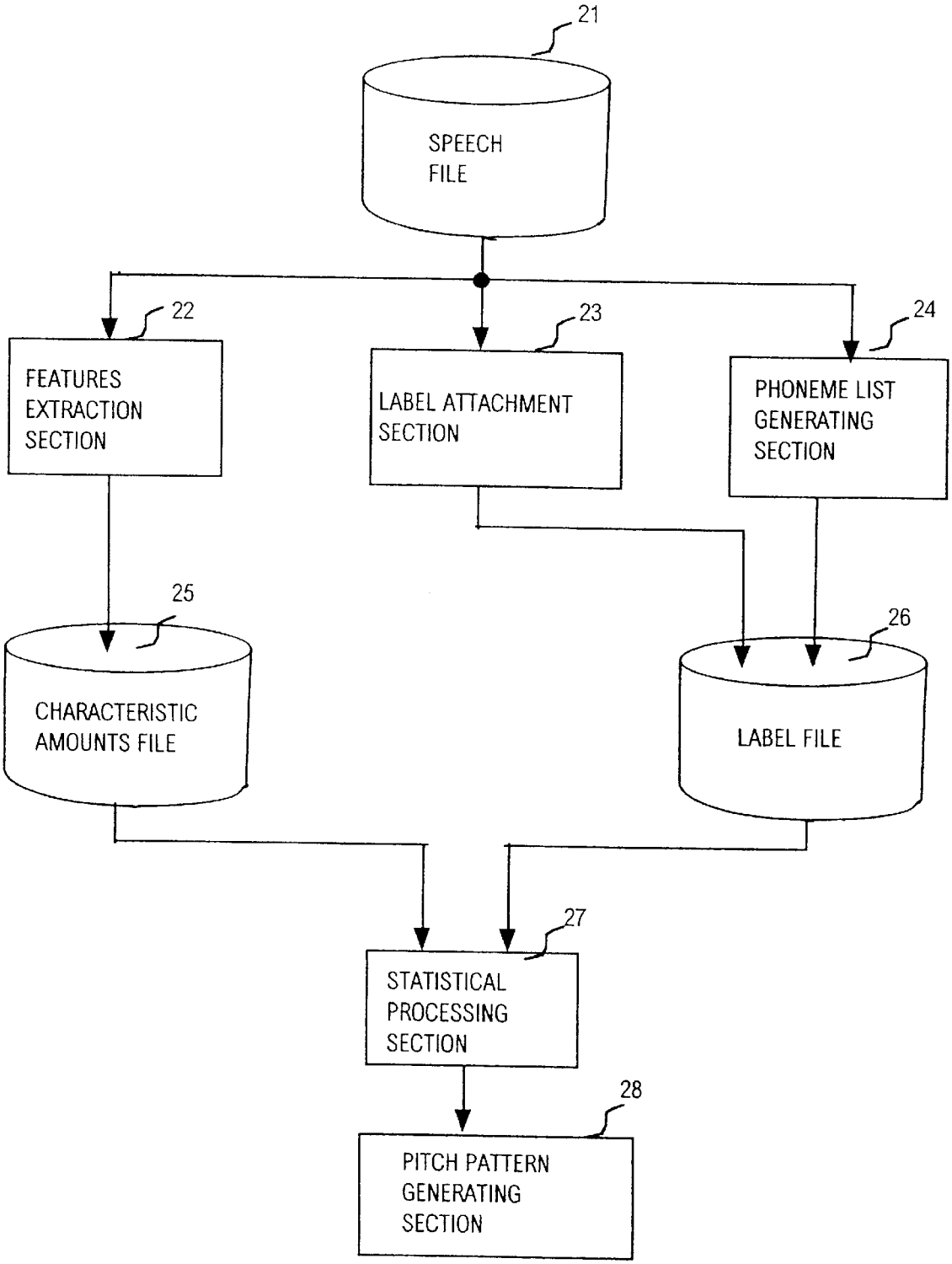
FIG. 22 PRIOR ART
FIG. 22 is a general system block diagram of an apparatus for implementing a second example of a prior art method of speech synthesization; and, FIG. 23 is a graph for use in describing the operation of the second example of a prior art method.
Figure 23:
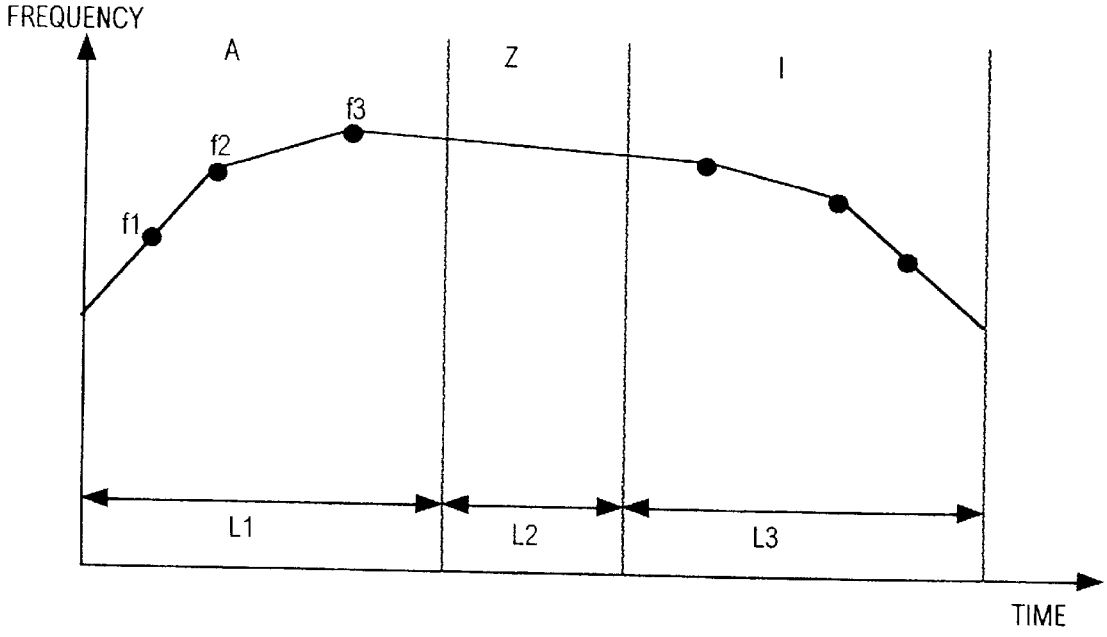
FIG. 23 PRIOR ART

FIG. 20 is a general system block diagram of an apparatus for implementing the fifth embodiment of a method of speech synthesis described above. The apparatus is formed of a primary data/phonetic label sequence conversion section 101, a prosodic template selection section 102, a prosodic template memory 153 having a number of prosodic templates stored therein, an acoustic waveform segment selection section 104, an acoustic waveform segment memory 105, and an acoustic waveform segment concatentation section 108, whose configuration and operation can be respectively similar to those of the corresponding sections of the preceding apparatus embodiments described hereinabove. In addition, the configuration and operation of the auditory perceptual timing point adjustment section 126 can be substantially identical to those of the auditory perceptual timing point adjustment section 126 of the apparatus of FIG. 15 described above, i.e., for executing shaping of requisite vowel portions of the acoustic waveform segments produced from the acoustic waveform segment selection section 104, such as to match the intervals between the auditory perceptual timing point positions of syllables expressed by that acoustic waveform segments to the corresponding intervals in the selected prosodic template, as described hereinabove referring to FIG. 13.

The pitch data of each prosodic template stored in the the prosodic template memory 153 of the apparatus of FIG. 20 consists of average values of pitch period derived for respective ones of a fixed plurality of vowel sections (such as three or four sections) of each of the vowel portions of the aforementioned sequence of enunciations of the reference syllable. Similarly, the speech power data of each prosodic template consists of average pitch values derived for respective ones of these vowel sections of each vowel portion of the reference syllable enunciations. The apparatus also includes an acoustic waveform segment pitch period and speech power adjustment section 157, which utilizes these stored average values as described in the following.

It will be assumed that the rythm data of each prosodic template consists of respective intervals between auditory perceptual timing points of adjacent pairs of the enunciated reference syllables, as for the apparatus of FIG. 15. However it would be equally possible to utilize any of the other methods of matching the rythm of a speech item to that specified by a template, described hereinabove.

With this embodiment, when a primary data set for an object speech item is received by the primary data/phonetic label sequence conversion section 101 and a corresponding prosodic template is selected from the prosodic template memory 153, the auditory perceptual timing point position data of that prosodic template are supplied to the auditory perceptual timing point adjustment section 126 together with the sequence of acoustic waveform segments corresponding to the object speech item, supplied from the acoustic waveform segment selection section 104. In addition, the average pitch period values and peak value for each of the sections of each vowel of the prosodic template are supplied to the acoustic waveform segment pitch period and speech power adjustment section 107.

The sequence of reshaped acoustic waveform segments which are obtained from the auditory perceptual timing point adjustment section 126 (as described for the apparatus of FIG. 15) are supplied to the acoustic waveform segment pitch period and speech power adjustment section 157, which executes reshaping of the waveform segments within each vowel section of each vowel expressed by the acoustic waveform segments, to set each of the peak value in that vowel section to the average peak value of the corresponding vowel section of the corresponding vowel in the selected prosodic template, and also to set each of the pitch periods in that vowel section to the average value of pitch period of the corresponding vowel section of the corresponding vowel in the selected prosodic template. The resultant final reshaped sequence of acoustic waveform segments are supplied to the acoustic waveform segment concatenation section 108, to be linked to form a continuous waveform as described for the preceding embodiments, expressing the requisite synthesized speech.

It can thus be understood that the apparatus of FIG. 20 differs from the previous embodiments in that the prosodic template memory 153 has stored therein, as the pitch data and speech power data of each prosodic template, respective average values of peak value for each of the aforementioned vowel sections of each vowel portion of each syllable that is expressed by that prosodic template, and respective average values of pitch period for these vowel sections, rather than data expressing individual peak values and pitch period values.

From the above description it can be understood that with the present invention, matching of the pitch of a vowel expressed by the sequence of acoustic waveform segments to the corresponding vowel in the prosodic template can be executed either by:

(a) executing waveform reshaping to make the respective pitch periods, i.e., the respective durations of the pitch waveform cycles of that vowel portion of the acoustic waveform segments, substantially identical to the corresponding pitch periods of the corresponding vowel portion, expressed by the pitch data of the selected prosodic template, or (b) dividing each vowel of the object speech item, as expressed by the acoustic waveform segments, into a plurality of sections and matching the average value of pitch period in each section to an average value of pitch period that is specified for a corresponding section of a corresponding vowel by the pitch data of the selected prosodic template.

Similarly, matching of the speech power of a vowel expressed by the sequence of acoustic waveform segments to the speech power characteristic specified by the prosodic template can be executed either by:

(a) executing waveform shaping to match the respective peak values of successive pitch waveform cycles of that vowel. as expressed by an acoustic waveform segment, to the peak values of respectively corresponding pitch waveform cycles of the corresponding vowel as specified in the speech power data of the selected prosodic template, or (b) executing waveform shaping to match each peak value of the vowel to the average peak value of the corresponding vowel as expressed in the speech power data of the prosodic template, or, (c) dividing each vowel of the object speech item, as expressed by the acoustic waveform segments, into a plurality of sections and matching the peak values in each section to an average pitch value that is specified for a corresponding section of a corresponding vowel by the speech power data of the selected prosodic template.

It should be noted that although embodiments of the present invention have been described hereinabove on the assumption that Japanese language speech items are to be speech-synthesized, the principles of the invention are applicable to various other languages. As stated hereinabove, the term "mora" can be understood as being used in the above description and in the appended claims with the significance of "rythm intervals occupied by respective syllables", irrespective of the language in which speech synthesis is being performed.

As can be understood from the above description, to apply the principles of the present invention to a speech item, it is only necessary to:

(1) convert the speech item to a corresponding sequence of phonetic labels, (2) determine the number of morae and the accent type of the speech item, and use that information to select a corresponding one of a plurality of stored prosodic templates, each derived from a series of enunciations of one reference syllable, (3) generate a sequence of acoustic waveform segments corresponding to the phonetic label sequence, (4) execute waveform shaping of the sequence of acoustic waveform segments such as to match the rythm, pitch variation characteristic and speech power characteristic of the speech item to those specified by the selected prosodic template, and (5) link the resultant sequence of acoustic waveform segments to form a continuous acoustic waveform.

However it should be noted that it would be equally possible to employ a different order for the processing steps from the step sequences that have been described hereinabove for the respective embodiments. For example, it would be equally possible to first execute waveform shaping of the acoustic waveform segments to match the speech power and pitch variation characteristics of the object speech item to those specified by the selected prosodic template, then execute waveform shaping to match the rythm of the object speech item to that specified by the prosodic template.

Thus although the invention has been described hereinabove referring to specific embodiments, various modifications of these embodiments, or different arrangements of the constituents described for these embodiments could be envisaged, which fall within the scope claimed for the present invention.

What is claimed is:

1. A method of speech synthesization comprising:

deriving and storing beforehand in a memory a plurality of prosodic templates, each comprising rythm data, pitch data, and speech power data respectively expressing rythm, pitch and speech power characteristics of a sequence of enunciations of a reference syllable executed based on the rythm, pitch and speech power characteristics of a sample speech item, with each prosodic template classified according to a number of morae and accent type thereof, and executing speech synthesization of an object speech item by selecting and reading out from said plurality of stored prosodic templates a prosodic template having a number of morae and an accent type which are respectively identical to said number of morae and accent type of said object speech item, converting said object speech item to a corresponding sequence of acoustic waveform segments, adjusting said acoustic waveform segments such as to match the rythm of said object speech item, as expressed by said sequence of acoustic waveform segments, to said rythm which is expressed by said rythm data of said selected prosodic template, adjusting said acoustic waveform segments such as to match the pitch and speech power characteristics of said object speech item, as expressed by said sequence of acoustic waveform segments, to the pitch and speech power characteristics which are expressed respectively by said pitch data and speech power data of said selected prosodic template, to obtain a reshaped sequence of acoustic waveform segments, and linking said reshaped sequence of acoustic waveform segments into a continuous acoustic waveform.

2. The method of speech synthesization according to claim 1 wherein said rythm data of a prosodic template specifies the durations of respective vowels within said reference syllable enunciations, and wherein said operation of adjusting said acoustic waveform segments to match the rythm of said object speech item to that of said selected prosodic template comprises executing waveform shaping to adjust the duration of each vowel expressed by said acoustic waveform segments to a corresponding one of said vowel durations which are specified by said rythm data of said selected prosodic template.

3. A method of speech synthesization comprising executing beforehand a process of utilizing each of a plurality of sample speech items to derive and store a corresponding one of a plurality of prosodic templates by steps of:

in accordance with enunciation of said sample speech item, enunciating a number of repetitions of a single reference syllable which is identical to a number of syllables of said each sample speech item, utilizing rythm, pitch variations, and speech power variations which are respectively similar to rythm, pitch variations in said enunciation of the sample speech item, converting said audibly enunciated repetitions of the reference syllable into digital data, and analyzing said data to derive a prosodic template as a combination of rythm data expressing the rythm of said enunciated repetitions, pitch data expressing a pitch variation characteristic of said enunciated repetitions, and speech power data expressing a speech power variation characteristic of said enunciated repetitions, and storing said prosodic template in a memory, classified in accordance with a number of morae and accent type of said enunciated repetitions;

and executing speech synthesization of an object speech item by steps of:

receiving a set of primary data expressing an object speech item which is to be speech-synthesized, generating a sequence of phonetic labels respectively corresponding to successive syllables of said object speech item, judging, based on said phonetic labels, a total number of morae and accent type of said object speech item, selecting and reading out from said memory a prosodic template having an identical number of morae and identical accent type to those of said object speech item, generating a sequence of acoustic waveform segments respectively corresponding to said phonetic labels, executing first waveform shaping of said acoustic waveform segments to obtain a sequence of reshaped acoustic waveform segments which express said object speech item with a rythm which matches the rythm expressed by selected prosodic template, executing second waveform shaping of said reshaped acoustic waveform segments to adjust the pitch and speech power characteristics of each syllable expressed by said reshaped acoustic waveform segments to match the pitch and speech power characteristics of a correspondingly positioned syllable expressed by said selected prosodic template, thereby obtaining a final sequence of acoustic waveform segments, and executing final waveform shaping to link successive ones of said final sequence of acoustic waveform segments to form a continuous acoustic waveform.

4. The method of speech synthesization according to claim 3 wherein said rythm data of a prosodic template expresses respective durations of vowels of said reference syllable enunciations, and wherein said first waveform shaping step comprises adjustment of the duration of each vowel expressed in said acoustic waveform segments to match a corresponding vowel duration value that is expressed by said rythm data of said selected prosodic template.

5. The method of speech synthesization according to claim 4, wherein an increase of vowel duration is achieved by executing, in successive alternation, an operation of copying a leading pitch waveform cycle of a set of pitch waveform cycles expressing said vowel within an acoustic waveform segment to a leading position in said set and an operation of copying a final pitch waveform cycle of said set of pitch waveform cycles to a final position in said set, and wherein a decrease of vowel duration is achieved by executing, in successive alternation, an operation of deleting a pitch waveform cycle from a position which is close to a leading position in said set of pitch waveform cycles and an operation of deleting a pitch waveform cycle from a position which is close to a final position in said set.

6. The method of speech synthesization according to claim 3, wherein said rythm data of each prosodic template express respective durations of intervals between each of successive pairs of adjacent reference time points, said reference time points being respectively defined in each of said morae of the template, and wherein said first waveform shaping is executed such as to match the duration of each of respective intervals between predetermined reference time points defined in successive pairs of adjacent syllables of said object speech item to the duration of a corresponding interval which is specified by said rythm data of the selected prosodic template.

7. The method of speech synthesization according to claim 3, wherein said pitch data of a prosodic template express respective durations of pitch periods of pitch waveform cycles within each of respective vowels of said enunciations of the reference syllable, said second waveform shaping step comprises matching the durations of each of respective pitch periods in each vowel of said speech item to the corresponding pitch periods of a corresponding vowel expressed by said selected prosodic template, and said speech power data of a prosodic template express respective peak value of pitch waveform cycles within each of said vowels of said reference syllable enunciations, and wherein said second waveform shaping step further comprises matching the magnitudes of respective peak values of pitch waveform cycles in each vowel of said speech item to the corresponding peak values of a corresponding vowel expressed by said selected prosodic template.

8. The method of speech synthesization according to claim 3, wherein said pitch data of a prosodic template express respective durations of pitch periods of pitch waveform cycles within each of respective vowels of said enunciations of the reference syllable, said second waveform shaping step comprises matching the durations of each of respective pitch periods in each vowel of said speech item to the corresponding pitch periods of a corresponding vowel of said enunciations of the reference syllable, as expressed the pitch data of said selected prosodic template, and said speech power data of a prosodic template express respective average peak values of pitch waveform cycles within each of said vowels of said reference syllable enunciations, and wherein said second waveform shaping step further comprises matching the average peak value of each vowel of said speech item to the average peak value of a corresponding vowel of said enunciations of the reference syllable, as expressed by said speech power data of the selected prosodic template.

9. The method of speech synthesization according to claim 3, wherein said pitch data of a prosodic template express respective average durations of pitch period within respective ones of a fixed plurality of sections of each vowel of said enunciations of the reference syllable, said second waveform shaping step comprises matching the average duration of each pitch period in each of respective sections of each Vowel of said speech item to the average pitch period value of a corresponding section of a corresponding vowel of said reference syllable enunciations, as expressed by said pitch data of said prosodic template, said speech power data of a prosodic template express respective average peak values in each of said vowel sections of said enunciations of the reference syllable, and said second waveform shaping step further comprises matching the average each peak value in each of said vowel sections of said object speech item to an average peak value of a corresponding section of a corresponding vowel of said reference syllable enunciations, as expressed by said speech power data of said selected prosodic template.

10. A method of speech synthesization comprising executing beforehand a process of utilizing each of a plurality of sample speech items to derive and store a corresponding one of a plurality of prosodic templates by steps of:

in accordance with enunciation of said sample speech item, enunciating a number of repetitions of a single reference syllable which is identical to a number of syllables of said each sample speech item, utilizing rythm, pitch variations, and speech power variations which are respectively similar to rythm, pitch variations in said enunciation of the sample speech item, converting said audibly enunciated repetitions of the reference syllable into digital data, defining respective reference time points at fixed positions within each of said enunciations of the reference syllable, and analyzing said data to derive a prosodic template as a combination of rythm data expressing the rythm of said enunciated repetitions as respective durations of intervals between adjacent pairs of said reference time points, pitch data expressing a pitch variation characteristic of said enunciated repetitions, and speech power data expressing a speech power variation characteristic of said enunciated repetitions, and storing said prosodic template in a memory, classified in accordance with a number of morae and accent type of said enunciated repetitions of the reference syllable;

and executing speech synthesization of an object speech item by steps of:

receiving a set of primary data expressing an object speech item which is to be speech-synthesized, generating a sequence of phonetic labels respectively corresponding to successive syllables of said object speech item, judging, based on said phonetic labels, a total number of morae and accent type of said object speech item, selecting and reading out from said memory a prosodic template having an identical number of morae and identical accent type to those of said object speech item, generating a sequence of acoustic waveform segments respectively corresponding to said phonetic labels, and defining respective reference time points within each of the syllables of said object speech item as expressed by said acoustic waveform segments, executing first waveform shaping of said acoustic waveform segments to obtain a sequence of reshaped acoustic waveform segments which express said object speech item with intervals between adjacent pairs of said reference time points thereof made respectively identical to corresponding ones of said intervals expressed by said rythm data of said selected prosodic template, executing second waveform shaping of said reshaped acoustic waveform segments to adjust the pitch and speech power characteristics of each syllable expressed by said reshaped acoustic waveform segments to match the pitch and speech power characteristics of a corresponding one of said enunciations of the reference syllable, as expressed by said pitch data and speech power data of said selected prosodic template, thereby obtaining a final sequence of acoustic waveform segments, and executing final waveform shaping to link successive ones of said final sequence of acoustic waveform segments to form a continuous acoustic waveform.

11. The method of speech synthesization according to claim 10, wherein said reference time points are respectively defined in all syllables of said object speech item other than an initial syllable and a final syllable.

12. The method of speech synthesization according to claim 10, wherein said reference time points are respective vowel energy center-of-gravity points of vowels of syllables.

13. The method of speech synthesization according to claim 10, wherein said reference time points are respective starting points of vowels of syllables.

14. The method of speech synthesization according to claim 10, wherein said reference time points are respective auditory perceptual timing points of syllables.

15. The method of speech synthesization according to claim 10, wherein said first waveform shaping is executed to adjust the duration of each of respective vowels of syllables of said object speech item by an amount and direction that are required to effect said matching of durations of intervals between pairs of reference time points to the corresponding intervals expressed by the selected prosodic template.

16. The method of speech synthesization according to claim 10, wherein said pitch data of a prosodic template express respective durations of pitch periods of pitch waveform cycles within each of respective vowels of said enunciations of the reference syllable, said second waveform shaping step comprises matching the durations of each of respective pitch periods in each vowel of said speech item to the corresponding pitch periods of a corresponding vowel expressed by said selected prosodic template, said speech power data of a prosodic template express respective peak value of pitch waveform cycles within each of said vowels of said reference syllable enunciations, and said second waveform shaping step further comprises matching the magnitudes of respective peak values of pitch waveform cycles in each vowel of said speech item to the corresponding peak values of a corresponding vowel expressed by said selected prosodic template.

17. The method of speech synthesization according to claim 10, wherein said pitch data of a prosodic template express respective durations of pitch periods of pitch waveform cycles within each of respective vowels of said enunciations of the reference syllable, said second waveform shaping step comprises matching the durations of each of respective pitch periods in each vowel of said speech item to the corresponding pitch periods of a corresponding vowel of said enunciations of the reference syllable, as expressed the pitch data of said selected prosodic template, and said speech power data of a prosodic template express respective average peak values of pitch waveform cycles within each of said vowels of said reference syllable enunciations, and wherein said second waveform shaping step further comprises matching the average peak value of each vowel of said speech item to the average peak value of a corresponding vowel of said enunciations of the reference syllable, as expressed by said speech power data of the selected prosodic template.

18. The method of speech synthesization according to claim 10, wherein said pitch data of a prosodic template express respective average durations of pitch period within respective ones of a fixed plurality of sections of each vowel of said enunciations of the reference syllable, said second waveform shaping step comprises matching the average duration of each pitch period in each of respective sections of each vowel of said speech item to the average pitch period value of a corresponding section of a corresponding vowel of said reference syllable enunciations, as expressed by said pitch data of said prosodic template, said speech power data of a prosodic template express respective average peak values in each of said vowel sections of said enunciations of the reference syllable, and said second waveform shaping step further comprises matching the average each peak value in each of said vowel sections of said object speech item to an average peak value of a corresponding section of a corresponding vowel of said reference syllable enunciations, as expressed by said speech power data of said selected prosodic template.

19. The method of speech synthesization according to claim 10, wherein said steps of executing speech synthesization of an object speech item further comprise steps of judging whether said object speech item satisfies a condition of having at least three morae, with said morae including anaccent core, and, when said object speech item is found to meet said condition and includes at least one mora which is not one of a pair of leading mora, said accent core and an immediately succeeding mora, or two final morae, for each syllable of said object speech item which corresponds to a mora other than one of said pair of leading morae, said accent core and immediately succeeding mora, or two final morae of said said object speech item:

deriving an interpolated position for the reference timing point of said syllable, and executing waveform shaping of said acoustic waveform segments to adjust the position of the reference timing point of said syllable to coincide with said interpolated position, and deriving interpolated values of pitch period for the respective pitch waveform cycles constituting the vowel of said syllable, and executing waveform shaping of said acoustic waveform segments to adjust the values of pitch period of said vowel to coincide with respectively corresponding ones of said interpolated values.

20. A speech synthesization apparatus comprising a prosodic template memory having stored therein a plurality of prosodic templates, each of said prosodic templates being a combination rythm data, pitch data and speech power data which respectively express rythm, pitch variation and speech power variation characteristics of a sequence of enunciations of a reference syllable executed in accordance with the rythm, pitch variations and speech power variations of an enunciated sample speech item, and each said prosodic template being classified in accordance with a number of morae and accent type thereof, means coupled to receive a set of primary data expressing an object speech item, for converting said primary data set to a corresponding sequence of phonetic labels and for determining from said sequence of phonetic labels the total number of morae and the accent type of said object speech item, means for selecting one of said plurality of prosodic templates which has a total number of morae and accent type which are respectively identical to said total number of morae and accent type of said object speech item, means for converting said sequence of phonetic labels to a corresponding sequence of acoustic waveform segments, first adjustment means for executing waveform shaping of said acoustic waveform segments to obtain a sequence of reshaped acoustic waveform segments which express said object speech item with a rythm that matches said rythm expressed by said rythm data of said selected prosodic template, second adjustment means for executing executing waveform shaping of said reshaped acoustic waveform segments to adjust the pitch characteristic and speech power characteristic of said object speech item, as expressed by said reshaped acoustic waveform segments, to match the pitch characteristic and speech power characteristic expressed by said pitch data and speech power data of said selected prosodic template, thereby obtaining a final sequence of acoustic waveform segments, and acoustic waveform segment concatenation means for executing waveform shaping to link successive ones of said final sequence of acoustic waveform segments to form a continuous acoustic waveform.

21. The speech synthesization apparatus according to claim 20, wherein said rythm data of each said prosodic template express respective durations of each of successive vowels of said enunciations of said reference syllable, and said first adjustment means comprises means for executing waveform shaping of said acoustic waveform segments to adjust the duration of each vowel of a syllable expressed in said sequence of acoustic waveform segments to match the duration of a vowel of the corresponding syllable that is expressed in said selected prosodic template.

22. The speech synthesization apparatus according to claim 20, wherein said rythm data of said each prosodic template express respective intervals between adjacent pairs of reference time points, with said reference time points being respectively defined at a fixed point within each of said enunciations of the reference syllable, and said first adjustment means comprises means for defining reference time points within said object speech item, respectively corresponding to said reference time points of said prosodic template, and for executing waveform shaping of said acoustic waveform segments such as to match each interval between an adjacent pair of said reference time points of said object speech item to a corresponding one of said intervals between reference time points of said selected prosodic template.

23. The speech synthesization apparatus according to claim 22, wherein said reference time points are respectively defined in all syllables of said object speech item other than an initial syllable and a final syllable.

24. The speech synthesization apparatus according to claim 22, wherein said reference time points are vowel energy center-of-gravity points of respective vowels.

25. The speech synthesization apparatus according to claim 22, wherein said reference time points are starting points of respective vowels.

26. The speech synthesization apparatus according to claim 22, wherein said reference time points are auditory perceptual timing points of respective syllables.

27. The speech synthesization apparatus according to claim 22, further comprising reference time point interpolation means (140), pitch period interpolation means (141), and judgment means (139) for judging whether said object speech item satisfies a condition of having at least three morae, with one of said morae being an accent core, wherein said first adjustment means (136) is controlled by said judgement means, when said condition is found to be satisfied, to execute said waveform shaping to match only the durations of an interval between reference time points of syllables of said two leading morae, an interval between reference time points of syllables of said accent core and an immediately succeeding mora, and an interval between syllables of a final two morae of said object speech item, to respectively corresponding intervals which are specified by said rythm data of said selected prosodic template, said reference time point interpolation means (140) is controlled by said judgement means to derive an interpolated reference time point for each syllable which corresponds to any mora of said speech item other than said two leading mora, said accent core and immediately succeeding mora, and two final mora, and to execute waveform shaping of the acoustic waveform segment expressing the vowel of said each syllable to establish said interpolated reference time point for said syllable, said pitch period interpolation means (141) is controlled by said judgement means to derive interpolated values of pitch period for the vowel of said each syllable and to execute waveform shaping of the acoustic waveform segment expressing said vowel to establish said interpolated values of pitch period, and wherein, when said condition is satisfied for an object speech item, said acoustic waveform segment concantenation means (138) combines shaped waveform segments produced from said second adjustment means (137) and shaped waveform segments produced from said pitch period interpolation means (141) into an original sequence of said waveform segments, before linking said waveform segments into said continuous acoustic waveform.

28. The speech synthesization apparatus according to claim 20, wherein said speech power data of each of said prosodic templates express the peak values of respective pitch waveform cycles in each vowel of said enunciated reference syllables and said pitch data of said each prosodic template express respective values of pitch periods between adjacent pairs of said pitch waveform cycles in said each vowel, and said second adjustment means comprises means for executing waveform shaping of said acoustic waveform segments to match the peak value of each pitch waveform cycle of each vowel that is expressed by said acoustic waveform segments to the peak value of the corresponding pitch waveform cycle of a corresponding vowel of said enunciations of the reference syllable, as expressed by said speech power data of the selected prosodic template, and to match the period between each pair of successive pitch waveform cycles of each vowel that is expressed by said acoustic waveform segments to the pitch period between a corresponding pair of pitch waveform cycles of a corresponding vowel of said enunciations of the reference syllable, as expressed by said pitch data of the selected prosodic template.

29. The speech synthesization apparatus according to claim 20, wherein said data expressing a speech power characteristic, in each of said prosodic templates, express the average peak values of pitch waveform cycles for each of respective of vowels of said reference syllable enunciations, and said pitch characteristic expresses respective periods between each of adjacent pairs of pitch waveform cycles of said vowels, and said second adjustment means comprises means for executing waveform shaping of said acoustic waveform segments to match the average peak value of each vowel expressed by said acoustic waveform segments to the average peak value of a corresponding vowel of said reference syllable enunciations, expressed by said speech power data of said selected prosodic template, and to match the pitch periods of respective pitch waveform cycles of each vowel that is expressed by said acoustic waveform segments to the pitch period of corresponding pitch waveform cycles of a corresponding vowel of said reference syllable enunciations, expressed by said pitch data of said selected prosodic template.

30. The speech synthesization apparatus according to claim 20, wherein each portion of said each prosodic template which corresponds to one vowel of one of said repetitions of the reference syllable has been divided into a fixed plurality of vowel sections, and respective average values of period between adjacent pitch waveform cycles have been derived for each of said vowel sections as said pitch data of said each prosodic template, while respective average peak value of said vowel sections have been derived as said speech power data of said each prosodic template, and, wherein said second adjustment means comprises means for dividing each vowel of a syllable of said object speech item into said fixed plurality of vowel sections, for executing waveform shaping of said sequence of acoustic waveform segments such as to match the average peak value of each section of each vowel of said speech item to the average peak value of the corresponding section of the corresponding vowel of said enunciations of the reference syllable, as expressed by said speech power data of the selected prosodic template, and means for executing waveform shaping of said sequence of acoustic waveform segments such as to match the average value of pitch period of said each section of each vowel of said speech item to the average value of pitch period of the corresponding section of the corresponding vowel of said enunciations of the reference syllable, as expressed by said pitch data of the selected prosodic template.

* * * * *